US008313185B2

(12) United States Patent
Hatasa et al.

(10) Patent No.: US 8,313,185 B2
(45) Date of Patent: Nov. 20, 2012

(54) LIQUID CONTAINER AND LIQUID CONTAINER PACKAGE

(75) Inventors: Nobuyuki Hatasa, Kawasaki (JP); Yasuo Kotaki, Yokohama (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1278 days.

(21) Appl. No.: 11/727,590

(22) Filed: Mar. 27, 2007

(65) Prior Publication Data

US 2007/0229632 A1 Oct. 4, 2007

(30) Foreign Application Priority Data

Mar. 31, 2006 (JP) ..... 2006-099816

(51) Int. Cl.
*B41J 2/19* (2006.01)

(52) U.S. Cl. ..... 347/92; 347/86

(58) Field of Classification Search ..... 347/89, 347/92, 85, 86

See application file for complete search history.

(56) References Cited

U.S. PATENT DOCUMENTS

| | | | | |
|---|---|---|---|---|
| 3,789,585 | A * | 2/1974 | Arnold et al. | 96/237 |
| 4,749,082 | A * | 6/1988 | Gardiner et al. | 206/349 |
| 5,113,205 | A * | 5/1992 | Sato et al. | 347/85 |
| 5,701,995 | A | 12/1997 | Higuma et al. | 206/205 |
| 6,039,442 | A * | 3/2000 | Hagiwara et al. | 347/89 |
| 6,116,722 | A | 9/2000 | Sato et al. | 347/85 |
| 6,247,782 | B1 * | 6/2001 | Takata | 347/30 |
| 6,286,945 | B1 | 9/2001 | Higuma et al. | 347/86 |
| 6,431,681 | B2 | 8/2002 | Hatasa et al. | 347/19 |
| 6,543,886 | B1 * | 4/2003 | Hattori et al. | 347/85 |
| 6,554,411 | B1 | 4/2003 | Hatasa et al. | 347/86 |
| 6,609,788 | B2 | 8/2003 | Hatasa et al. | 347/86 |
| 6,702,427 | B2 | 3/2004 | Shimizu et al. | 347/50 |
| 6,742,881 | B2 | 6/2004 | Kotaki et al. | 347/86 |
| 6,773,099 | B2 | 8/2004 | Inoue et al. | 347/86 |
| 6,824,258 | B2 | 11/2004 | Yamamoto et al. | 347/86 |
| 6,824,260 | B2 * | 11/2004 | Blease et al. | 347/86 |
| 6,969,161 | B2 | 11/2005 | Kuwabara et al. | 347/85 |
| 7,004,575 | B2 | 2/2006 | Inoue et al. | 347/86 |
| 7,055,941 | B2 | 6/2006 | Tsurui et al. | 347/86 |
| 7,118,204 | B2 | 10/2006 | Hatasa et al. | 347/86 |
| 7,192,111 | B2 | 3/2007 | Matsumoto et al. | 347/7 |
| 7,264,342 | B2 | 9/2007 | Yamamoto et al. | 347/86 |

(Continued)

FOREIGN PATENT DOCUMENTS

| | | |
|---|---|---|
| CN | 1100995 | 4/1995 |

(Continued)

OTHER PUBLICATIONS

Chinese Office Action dated Dec. 12, 2008, from corresponding Chinese Application No. 200710092211.2.

(Continued)

*Primary Examiner* — Charlie Peng
*Assistant Examiner* — Peter Radkowski
(74) *Attorney, Agent, or Firm* — Fitzpatrick, Cella, Harper & Scinto

(57) ABSTRACT

When a package in which a tank 1 is wrapped is opened, caused is an action of reversing vertical positions of an end face of the tank 1 having an ink supply portion 10, and an end face opposite to the foregoing end face. Along with this action, air existing inside the tank 1 ascends, and then is separated by air separating portions. Thus, a coloring material component inside the tank is stirred.

12 Claims, 20 Drawing Sheets

U.S. PATENT DOCUMENTS

| | | | | |
|---|---|---|---|---|
| 7,290,861 | B2 | 11/2007 | Inoue et al. | 347/49 |
| 2001/0024226 | A1* | 9/2001 | Sasaki | 347/86 |
| 2002/0122103 | A1* | 9/2002 | Yamamoto et al. | 347/85 |
| 2003/0020790 | A1 | 1/2003 | Kotaki et al. | 347/86 |
| 2003/0067517 | A1* | 4/2003 | Iri et al. | 347/85 |
| 2003/0085967 | A1* | 5/2003 | Ota et al. | 347/86 |
| 2003/0117450 | A1* | 6/2003 | Usui et al. | 347/7 |
| 2004/0114011 | A1* | 6/2004 | Matsushita et al. | 347/92 |
| 2004/0252167 | A1* | 12/2004 | Kimura | 347/85 |
| 2005/0041076 | A1* | 2/2005 | Katayama | 347/85 |
| 2005/0062818 | A1* | 3/2005 | Hashi et al. | 347/92 |
| 2005/0128267 | A1* | 6/2005 | Mishima | 347/92 |
| 2006/0007286 | A1 | 1/2006 | Ogawa et al. | 347/87 |
| 2006/0146107 | A1 | 7/2006 | Tsurui et al. | 347/86 |
| 2006/0274133 | A1 | 12/2006 | Inoue et al. | 347/93 |
| 2007/0257974 | A1 | 11/2007 | Hatasa et al. | 347/85 |
| 2007/0263052 | A1 | 11/2007 | Iijima et al. | 347/92 |

FOREIGN PATENT DOCUMENTS

| | | | |
|---|---|---|---|
| CN | 1405003 | | 3/2003 |
| EP | 1279511 | | 7/2002 |
| EP | 1279511 | | 1/2003 |
| EP | 1279511 | A2 * | 1/2003 |
| EP | 1602489 | | 6/2005 |
| EP | 1602489 | | 12/2005 |
| EP | 1602489 | A2 * | 12/2005 |
| JP | 62097852 | A * | 5/1987 |
| JP | 2001-270131 | | 10/2001 |
| JP | 2001-293880 | | 10/2001 |
| JP | 2001-328277 | | 11/2001 |
| JP | 2005066520 | A * | 3/2005 |
| JP | 2006-44153 | | 2/2006 |
| JP | 2006-044153 | | 2/2006 |
| JP | 2007216628 | A * | 8/2007 |

OTHER PUBLICATIONS

European Search Report dated Oct. 13, 2008, from corresponding European Application No. 07105184.1.

European Search Report dated Oct. 13, 2011 in counterpart European Application No. 11174329.0-2304.

* cited by examiner

LIQUID CONTAINER AND LIQUID CONTAINER PACKAGE

BACKGROUND OF THE INVENTION

1. Field of the Invention

The present invention relates to a liquid container and a package thereof. More specifically, the present invention relates to: a liquid container suitable for storing liquid such as ink used in inkjet printing; and a package thereof. In addition to a general printing apparatus, the liquid container of the present invention is also applicable to apparatuses such as: a copying machine; a facsimile having a communication system; and a word processor having a printing unit. Furthermore, the liquid container is also applicable to a liquid supply source of an industrial printing apparatus combined in a complex manner with various kinds of processing apparatuses.

2. Description of the Related Art

In an inkjet printing apparatus, a printing head and a liquid container (hereinafter, also referred to as an ink tank) are used in general. The ink tank is connected to the printing head, and thereby supplies liquid such as printing ink to the printing head. When printing is carried out, ink is ejected in accordance with image data through a fine ejection opening provided to the printing head, and thereby is landed on a printing medium. In this way, a desired image is formed.

Ink is supplied to the printing head from the ink tank as an ink supply source. As a method of supplying ink to a printing head, there is a method in which an ink tank containing ink is mounted on a carriage, and directly supplies the ink to the printing head. Additionally, there is another method in which an ink tank is arranged to a fixed portion of an apparatus, and with which ink is communicated between the ink tank and a printing head by using a supply tube. Here, in both methods, an ink tank is generally detachably attached to a printing apparatus so that the ink tank can be replaced with a new one when there is substantially no remaining amount of ink stored in the ink tank.

In recent years, the inkjet printing technology has come to be applied in a wide range of fields. The application of the inkjet printing technology has expanded into industrial uses, in addition to personal or home uses and office uses. Hence, inkjet printing apparatuses suitable for various uses have been developed. Additionally, as ink used therein, adopted are kinds of ink exhibiting characteristics favorable to various uses.

Kinds of ink are broadly categorized into: ink mainly containing dye component as a coloring material (hereinafter, referred to as dye ink); and ink mainly containing pigment component as a coloring material (hereinafter, referred to as pigment ink). In a case of use requiring light resistance and gas resistance of a printed subject, for example, use for a production of an outdoor display media, the pigment ink is often used particularly so that the sufficient fastness of an image can be secured.

However, in comparison with the dye ink, the pigment ink has various problems in terms of handling. For example, dispersibility of pigment component of a coloring material in the ink is one of the problems.

For example, pigment component does not dissolve into an ink solution like dye component, and floats in a dispersed state. For this reason, pigment particles gradually settle out due to the action of gravity, if an ink tank is left to stand still for a certain period of time. This causes a variation in the concentration distribution of the pigment particles in a vertical direction. In other words, a layer having a high concentration of the coloring material is formed in a lower part of the ink tank, and a layer having a low concentration of the coloring material is formed in an upper part of the ink tank. When printing is started and continued with this state being maintained, outputted images have a density variation between parts recoded in an earlier stage and in a later stage in using the ink tank.

For example, consider a configuration where an ink supply port is arranged in a part which is a bottom of an ink tank at a time when mounted, and where thus the ink tank supplied ink to a printing head. In this case, if printing is started with the ink tank being mounted in a state having the variation in concentration distribution, the ink is supplied initially from a lower layer having the higher concentration of the coloring material. As a result, an image is outputted which has a higher density than a required one. Afterward, the density of the image gradually becomes lower as the printing is continued and the ink in the ink tank is further consumed. At about the time when only a small amount of the ink remains, the remaining ink is only the one having the lower concentration of the color material than the ink at the start of the printing. Then, a printed subject may possibly have an insufficient density that cannot be expressed properly even if the printed subject is printed in accordance with the same image data as that used at the start of the printing. Particularly, the large diameter or the large specific gravity of pigment particle results in a remarkably large settling tendency. This produces such a large variation in concentration distribution that the influence on an image appears, even when the ink tank has been left out of use only for a few days.

Additionally, as for the dye ink, content component sometimes becomes separate from each other in the course of freezing in a case where the ink freezes in a cold climate area or the like. In this case, it leads to uneven distribution of the dye component itself in the ink tank, and a concentration gradient sometimes occurs in the dye ink although the gradient is not as severe as that in the case of the pigment ink.

As has been described above, the variation in concentration of a coloring material of ejected ink causes not only a problem of generating a density variation between output images in an earlier stage and a later stage in using an ink tank; but also the collapse of a color balance in a color inkjet printing system which expresses a desired hue under a predetermined color balance by using a plurality of color inks. Accordingly, this produces a problem that the unevenness in an image causes the image deterioration to be recognized.

Each of ink tanks disclosed respectively in Japanese Patent Laid-Open No. 2001-270131 and No. 2001-293880 is provided with a tubular member extending from an ink supply port of the tank into the interior of the tank. An ink absorber is included in the interior of the ink tank, and the tubular member is surrounded by this absorber. A plurality of holes used for allowing ink to flow into the tubular member are provided in a side face of the tubular member. The ink flows into the interior of the tubular member through the plurality of holes provided in the side face thereof. To be more precise, the ink flows into the interior of the tubular member not only from the holes close to the position of the supply port but also from the holes located far from the position of the supply port. Then, the ink is delivered to the outside of the tank from the supply port. In this manner, influence of a concentration gradient of ink coloring material is reduced, whereby the concentration of the coloring material of the delivered ink is maintained within a desired range.

However, in each of the above conventional examples, the ink absorber is provided in the interior of the ink tank, and the ink is contained in this absorber. In a case of an ink tank which does not include an ink absorber in order to increase the containing amount of ink, and which thus directly contains ink, no means that prevents coloring material component from settling out is provided. Consequently, the variation in concentration distribution of color material in the ink tank is larger than in the above conventional examples.

A period during which coloring material component settles as an ink tank is left to stand still is not only a period during which the ink is out of use after having been mounted in a printing apparatus (hereinafter, refer to an out-of-use period). The tank is left to stand still also in a period after the tank is manufactured until a user starts to use the tank (hereinafter, referred to as an unused period), that is, the period including: a distribution period; a display period for sale; and furthermore, a period during which a user or the like stores the tank. In reality, the unused period is longer than the out-of-use period, and it is considered that the variation in concentration distribution of color material becomes large in the unused period.

After the ink tank is mounted in the printing apparatus, the printing apparatus can perform an appropriate stirring operation for the ink tank. For example, the stirring operation is carried out by pressurizing and decompressing an ink supply path, such as a tube connected to the tank; and thus by causing the ink to flow or move inside the tank. In this manner, a stirring effect acts upon an entirety of the ink contained in the tank, and this achieves a state where the variation in concentration distribution is small (a state of the uniform distribution of a coloring material).

However, such an active stirring operation cannot be performed during the unused period. As a result, settling of a coloring material or pigment component progresses, and the variation in concentration distribution in a vertical direction of the tank may become extremely large in some cases. In a state where such large variation in concentration distribution have been generated, that is, a state where the coloring material is concentrated near an ink supply port, it becomes more difficult to reduce the variation in concentration distribution. A stirring effect cannot be sufficiently obtained in some cases at an early stage after the tank is mounted, even if the ink stirring operation inside the tank is performed by pressurizing and decompressing the ink supply path, such as the tube, connected to the tank. In particular, at an early stage after the tank starts to be used, it is inevitable to use highly concentrated ink resulting from the settling of a coloring material near the ink supply port of the tank. For this reason, an image having an extremely high density may be formed.

Consequently, in general, a user is recommended to perform a stirring operation, which is called "shaking by hands," prior to mounting of the tank to the apparatus. Specifically, that is an operation in which the user himself or herself shakes the ink tank, and thus moves the whole of the tank. When a user mounts a tank on an apparatus, and starts to use it without performing such a stirring operation because of his or her forgetting or neglect, an image having a high density may sometimes be formed in an early stage of printing. It is desirable to perform a stirring operation on the tank first, thereby improving the concentration distribution of color material, and then to perform printing. However, such an operation has to be manually performed by the user, while it is desirable that the operation be less troublesome. This situation brings about a conflicting problem therebetween.

SUMMARY OF THE INVENTION

In consideration of the abovementioned points, an object of the present invention is to provide a liquid container which allows a user to unconsciously and naturally perform a stirring operation of a coloring material component inside a tank by performing a series of procedures for mounting the tank in the apparatus; and which thus has a small variation in concentration distribution of the coloring material.

In addition, another object of the present invention is to provide a liquid container package that makes it possible to stir a coloring material component inside an ink tank, and thereby to obtain a state where the coloring material is uniformly distributed.

In an aspect of the present invention, there is provided a liquid container, which contains air in addition to liquid used by an inkjet printing apparatus, comprising: a first end portion having a liquid supply portion for supplying the contained liquid to the inkjet printing apparatus; a second end portion opposite to the first end portion; and an air separating portion which separates the air, and which extends between two opposite sides of the container having the largest areas among all sides of the container connecting first end portion and the second end portion with each other, wherein an air-liquid interface between the air and the liquid is located at the same level as or the higher level than the air separating portion in a posture of the ink tank with the first end portion facing vertically downward.

In another aspect of the present invention, there is provided a liquid container package configured by housing, in a pack member, a liquid container which includes: a first end portion having a liquid supply portion for supplying the contained liquid to the inkjet printing apparatus; a second end portion opposite to the first end portion; and an air separating portion separating the air, and extending between two opposite sides of the container having the largest areas among all sides of the container that connect first end portion and the second end portion with each other; and in which an air-liquid interface between the air and the liquid is located at the same level as or the higher level than the air separating portion in a posture of the ink tank with the first end portion facing vertically downward, wherein the pack member having: a notch provided in an first outer edge portion of the pack member where the first end portion of the housed liquid container is located; and a hole for suspension provided in an second outer edge portion, opposite to the first edge portion, of the pack member where the second end portion is located.

According to the present invention, air existing in the liquid container (an ink tank) moves along with an operation of turning over a side face having an ink supply port of the tank, and another side face opposite to the foregoing side face. In the course of this movement of the air, the air is separated by a structure inside the tank. As a result, stirring of liquid (mainly pigment ink) is promoted by the movements of the separated air inside the tank. Thereby, the present invention has an effect that an improved state of the distribution of component (mainly a coloring material) inside the liquid container (the ink tank) can be obtained only by requiring a minimum of stirring operation.

The liquid container package according to the present invention has an effect that stirring of a coloring material inside the liquid container can be performed in the course of carrying out a series of procedures which start from a state where the container is wrapped in the package, and end with a completion of mounting the container in the printing apparatus. To be more precise, the liquid container package has the effect that a stirring operation is naturally performed in the course of carrying out a procedure of: breaking the pack member so as to take out the liquid container from the package; and then mounting the liquid container thus taken out in the printing apparatus.

Further features of the present invention will become apparent from the following description of exemplary embodiments (with reference to the attached drawings).

DETAILED DESCRIPTION OF THE PREFERRED EMBODIMENTS

First Embodiment

Figure 1:
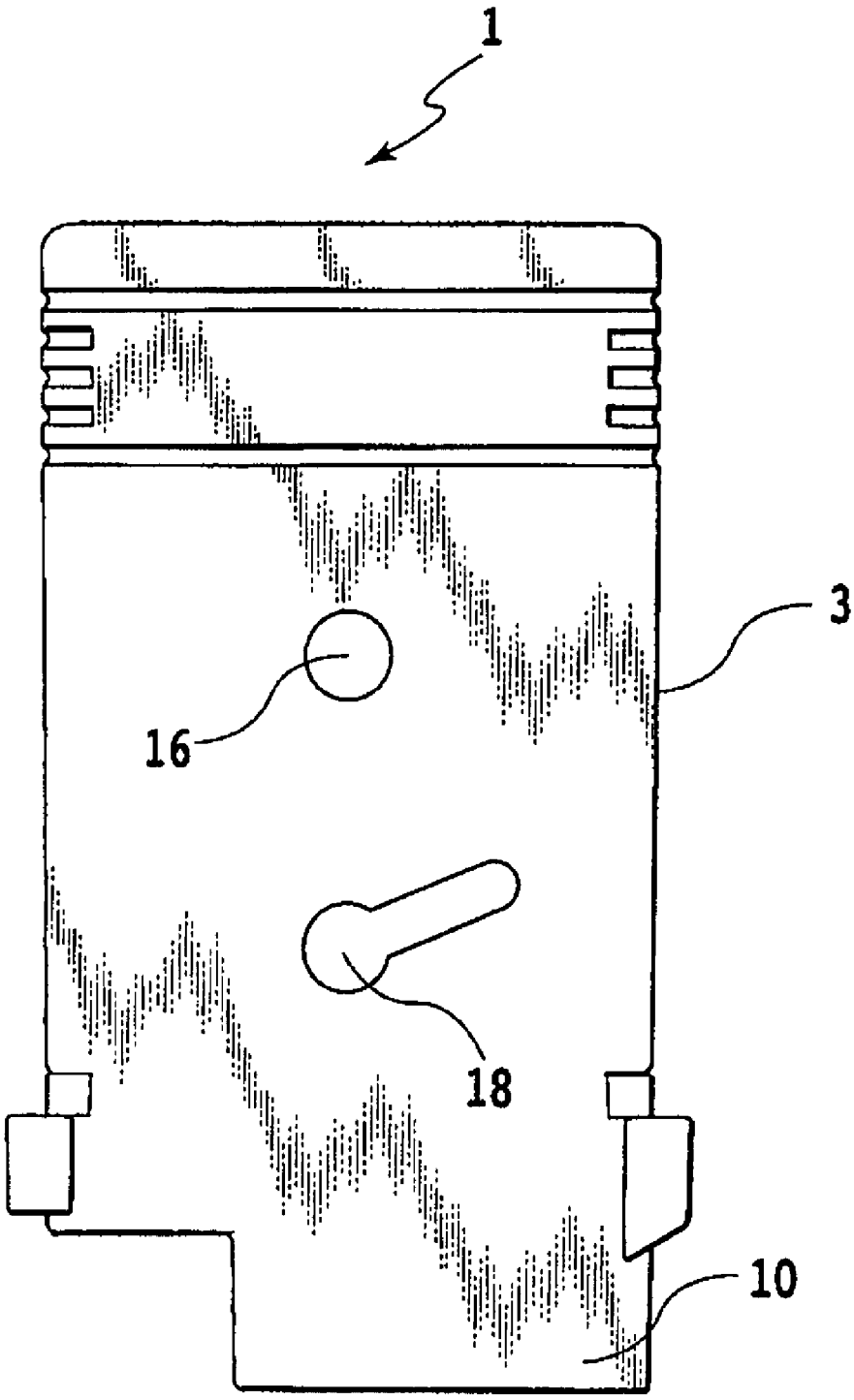
FIG. 1 is a front view of an external shape of an ink tank according to a first embodiment of the present invention.

FIG. 1 is a side view showing an ink tank according to a first embodiment of the present invention.

An ink tank 1 contains pigment ink of a color (for example, black, cyan, magenta, yellow or the like) aligned with a configuration of a printing apparatus part. The ink tank 1 is made of resin, such as, for example, PP or PE, and formed by using injection blow molding or the like. Each of components of the ink tank 1 is constructed by use of a technique such as ultrasonic welding, thermal welding, bonding or fitting. The ink tank 1 includes a tank casing 3 directly functioning as an ink containing portion. The tank casing 3 has a shape of a substantially rectangular solid. One of side faces of the tank casing 3 (hereinafter, defined as a front face) shown in FIG. 1 and another side face thereof opposite to the front face (hereinafter, defined as a back face) are faces forming the maximum areas of all faces of the rectangular solid shape.

Figure 2:
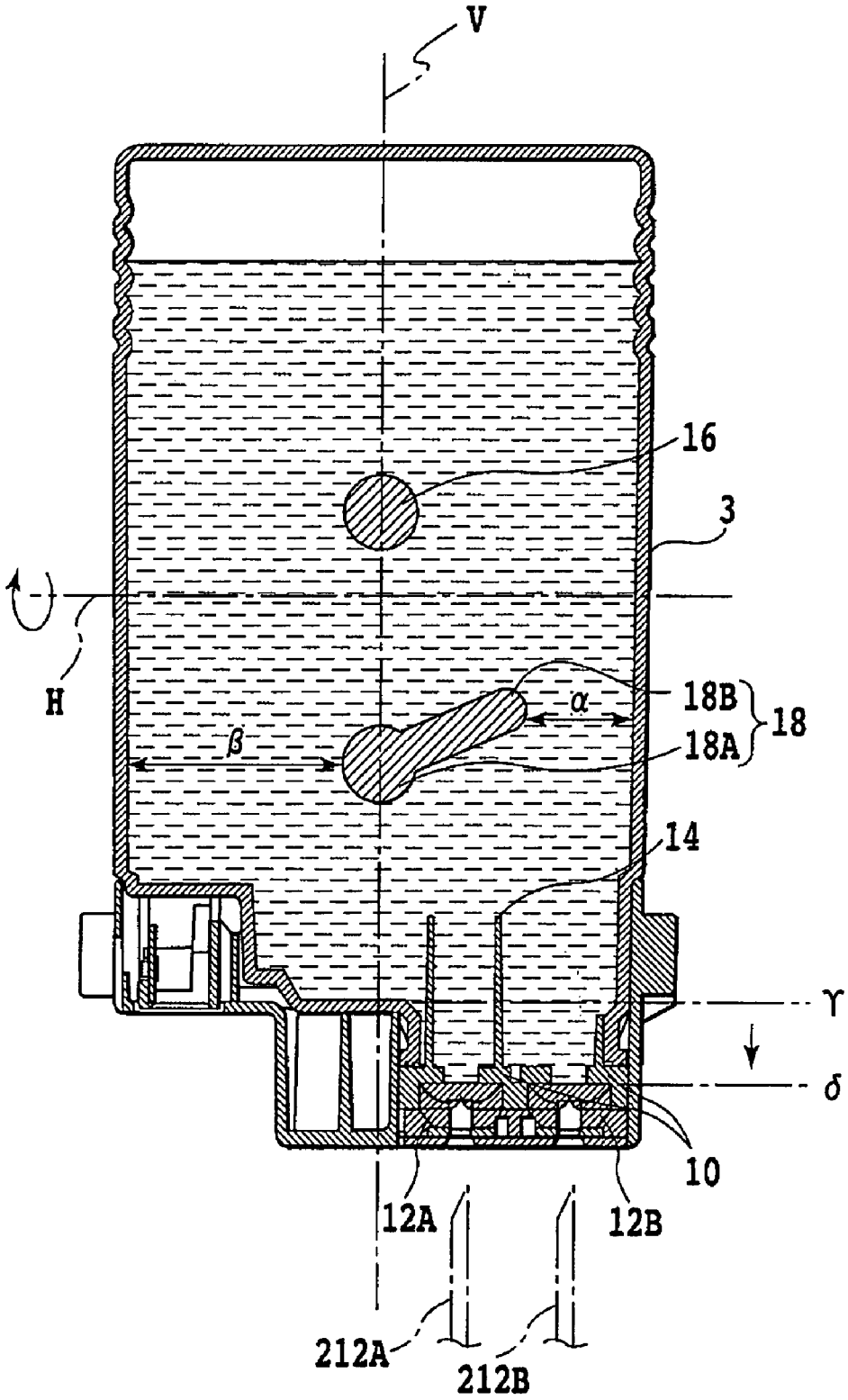
FIG. 2 is a cross-sectional view of an interior of the ink tank according to the first embodiment.

The ink tank 1 is detachable from and attachable to a fixed portion of the printing apparatus, and the ink tank 1 shown in FIGS. 1 and 2 shows a posture at the time when the ink tank 1 is mounted in the printing apparatus. That is a posture in which the ink supply portion 10 faces an ink supply needle and an atmosphere communicating needle located on the printing apparatus side. Additionally, as will be described later, this is a state where the ink tank 1 is wrapped in a package, and a state where the ink tank 1 is suspended with a hole provided to the package. The ink supply portion 10 is provided on a bottom face (first end portion) side which is the lowest portion in the gravity direction in the above posture. The ink supply portion 10 is provided at a position δ protruding in a direction shown by an arrow in FIG. 2 from a position γ corresponding to one of bottom faces of the ink tank. When the remaining amount of the ink is low, this configuration makes it possible to collect the remaining ink around the ink supply portion 10, and thus to efficiently use up the ink. Additionally, the ink supply portion 10 is arranged off to one side (the right side in the state shown in FIG. 2), from a central axis V extending in a longitudinal direction (a vertical direction in FIG. 2) of the ink tank 1.

Two joints 12A and 12B made of rubber are arranged on an end face of the ink supply portion 10. A hollow needle 212B provided to the printing apparatus can enter the ink tank 1 by penetrating the joint 12B, which is one of the two joints. When printing is performed after the tank is mounted, the ink in the tank is supplied through the hollow needle 212B to a printing head from the tank. A hollow needle 212A provided to an end portion of an atmosphere communicating pipe having an atmosphere opening portion can enter the ink tank 1 through the joint 12A, which is the other joint. A tubular member 14 surrounds around a region where this needle enters the tank. With this configuration, the ink is supplied to the printing head from the ink tank 1 along with an ink ejection operation of the head. At the same time, air of the amount equivalent to that of the supplied ink is introduced into the ink tank 1 through the atmosphere opening portion, and thereby an internal pressure of the ink tank 1 is maintained at a substantially constant level. Additionally, in this embodiment, a buffer chamber is provided in the atmosphere communicating pipe. When a pressure variation inside the ink tank occurs due to an environmental variation or the like, this configuration allows the pressure variation to be absorbed, and thereby prevents the pressure variation from affecting a printing head side. The buffer chamber can carry out a function of temporarily storing ink that overflows from the ink tank due to expansion of air inside the ink tank. Furthermore, this configuration is effective also in absorbing a pressure variation inside the ink tank during a stirring operation (pressurization and decompression of an ink supply path) performed by utilizing the configuration of the apparatus side. The ink supply path connecting the printing head and the ink tank with each other is composed of a tube and the like, though not illustrated.

Two air separating portions 16 and 18 are provided to the casing 3 of the ink tank 1, and each of the air separating portions 16 and 18 has a columnar structure extending between the front and back faces, which are opposite to each other. As will be described later, these air separating portions 16 and 18 perform air separation to form separated air pieces, then guide each of the separated air pieces independently, and thus function so as to promote stirring of ink. The air separating portions 16 and 18 may have structures in which diagonally shaded portions inside outlines thereof shown in FIG. 2 are not hollow (structures in which the diagonally shaded portions are filled with a material of the tank casing). Alternatively, the air separating portions 16 and 18 may have structures in which the diagonally shaded portions inside the outlines form portions recessed from the walls of the tank casing on front and back face sides, or, may have structures in which the diagonally shaded portions penetrate from the front face to the back face. It is essential only that a circumferential wall portion constituting the entirety or the outline of each of the air separating portions 16 and 18 continuously extend between the walls on the front and back face sides of the tank casing. Additionally, with this configuration, the air separating portions 16 and 18 can function also as reinforcement portions which prevent the tank from being deformed due to a pressure difference between the interior and the exterior of the ink tank.

The air separating portion 16 is provided at a portion which is on the central axis V shown in FIG. 2, and which is off to the side of a face (a second end portion) opposite to the face (the first end portion) having the ink supply portion 10. The air separating portion 16 has a substantially circular cross section. The air separating portion 18 is provided at a portion which is on the central axis V shown in FIG. 2, and which is off to the side of the face having the ink supply portion 10. The air separating portion 18 includes: a portion 18A being located on the central axis V and having a substantially circular cross section; and an inclined portion 18B extending from the portion 18A. The inclined portion 18B will be described here. In terms of a horizontal direction (a left-to-right direction of the tank) shown in FIG. 2, the inclined portion 18B has a configuration extending in the same direction (to the right side in FIG. 2) as the direction in which the ink supply portion 10 is off from the central axis V so as to cover a region over the ink supply portion. Moreover, in terms of a vertical direction (a top-to-bottom direction of the tank) shown in FIG. 2, the inclined portion 18B extends obliquely toward the side opposite to the ink supply portion 10. For this reason, when it is defined that a distance cc is a distance between a tip of the inclined portion 18B, and an inner wall of the casing on one side face of the ink tank which the tip of the inclined portion 18 faces, and that a distance $\beta$ is a distance between the portion 18A having the circular cross section, and an inner wall of another side face, the distance $\alpha$ is narrower than the distance $\beta$ ($\alpha<\beta$). Note that a portion $\alpha$, which forms the former distance, will be referred to as a narrow portion.

Hereinbelow, descriptions will be given of a phenomenon involved in the stirring in the ink tank, and user's operations.

The ink tank 1 is manufactured so as not to be completely filled with ink, but to also contain a predetermined amount of air exists therein. In the posture shown in FIG. 2, an air-liquid interface (a liquid level of the ink) is formed in a position higher than the air separating portion 16, and pigment component settles around the ink supply portion.

The ink tank 1 according to the present embodiment is subject to a stirring operation with the hands of a user before the ink tank 1 is mounted in the printing apparatus. The stirring operation mentioned in this example is to perform an operation (hereinafter, referred to as a turnover operation) of reversing vertical positions of the end face (the first end portion) having the ink supply portion 10, and the end face (the second end portion) opposite to the first end portion by rotating or turning the ink tank 1. In the present embodiment, the originally existing air and ink change their positions with each other. In the course of this position change of the air and ink, the air separating portions 16 and 18 appropriately separate the air into separated air pieces, and then guide each of the separated air pieces of the independently. In this manner, stirring of the ink is promoted.

Note that, in the ink tank of the embodiment, the air separating portions are provided so as to connect the front face side to the back face side. Accordingly, in performing the turnover operation, it is preferable that the ink tank 1 be rotated or turned in a direction of normal lines of these front and back faces. Specifically, it is preferable that the ink tank 1 is rotated or turned around a horizontal rotation axis H. The air separating portions can be provided so as to have a number, shapes and positions thereof which are appropriate in terms of ability thereof to perform effective air separation and the like in accordance with a shape of the ink tank. In terms of the provision of the air separating portions, any number, shapes and positions can be adopted if they are appropriate for the effective air separation, or the like, in accordance with the shape of the ink tank. It goes without saying that a direction of a rotation or a turn at the time of the turnover operation also is not limited to the direction of this example. In the structure of the ink tank described in the first embodiment and shown in FIG. 2, when the shapes of the air separating portions has the structures indicated by reference numerals 16 and 18, the ink tank becomes effective in performing efficient stirring.

Figure 3:
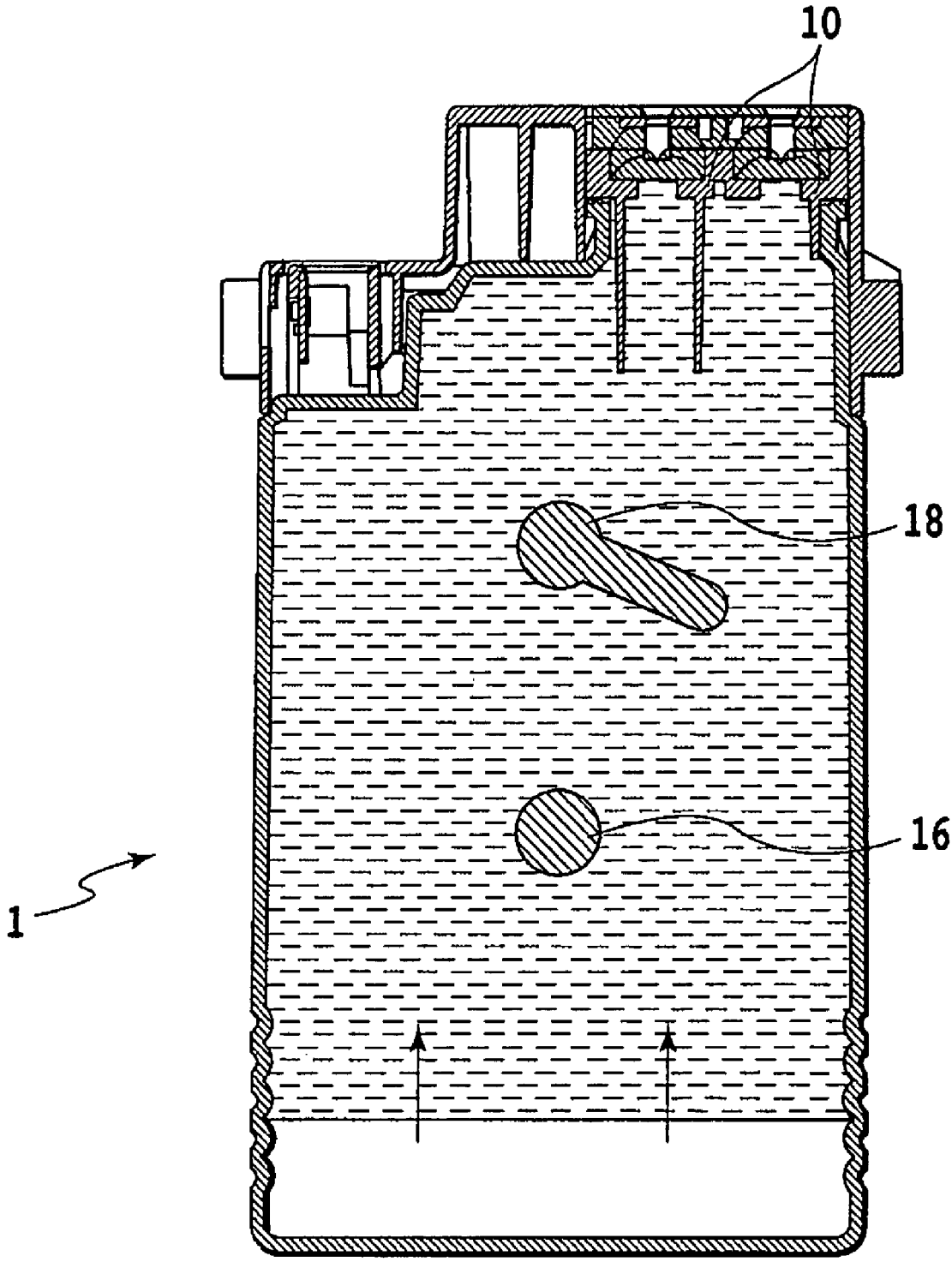
FIG. 3 is a cross-sectional view of the ink tank immediately after a turnover operation is performed from a state in FIG. 2.
Figure 4:
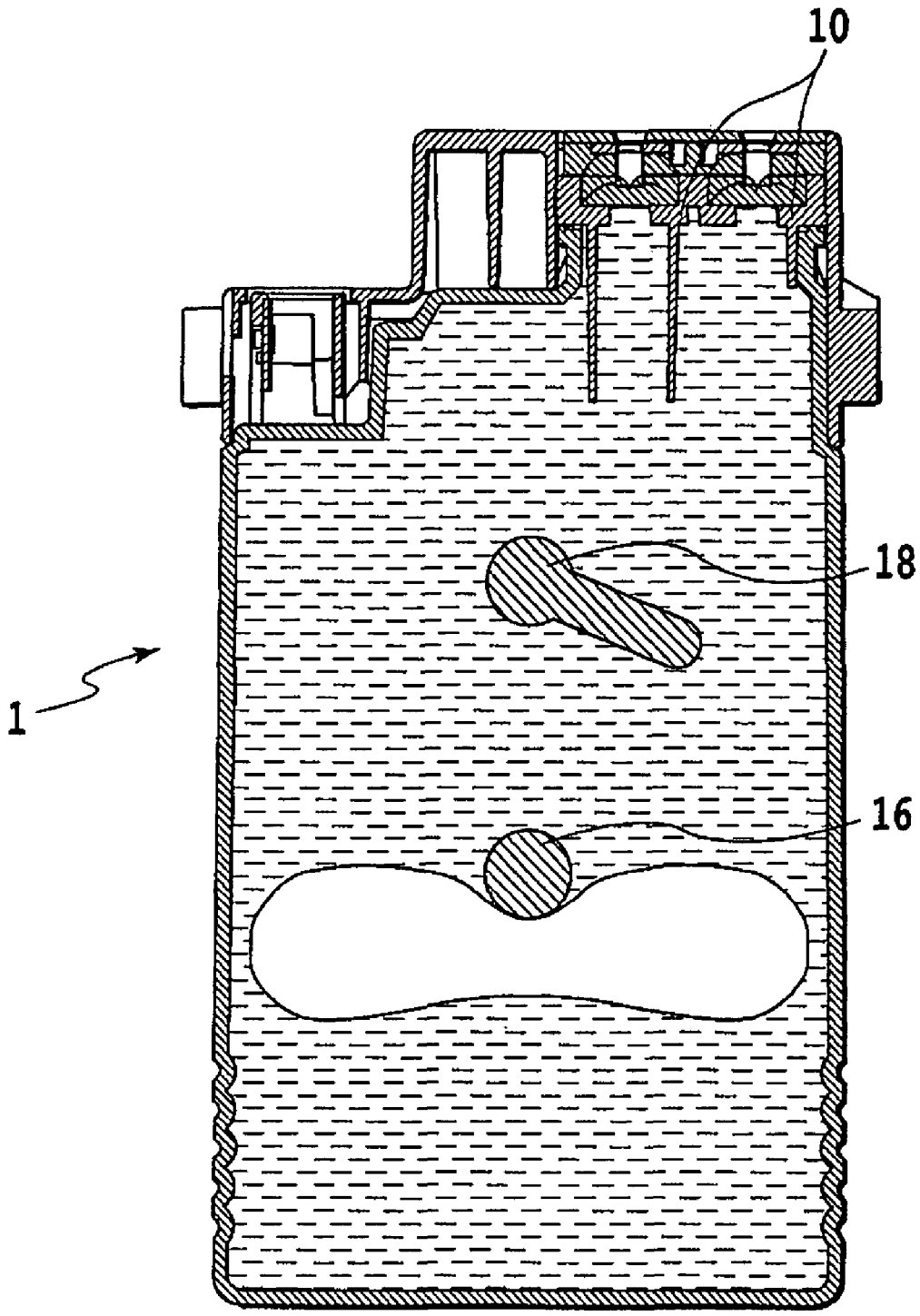
FIG. 4 is a cross-sectional view of the ink tank for illustrating a state where air goes ascending.
Figure 5:
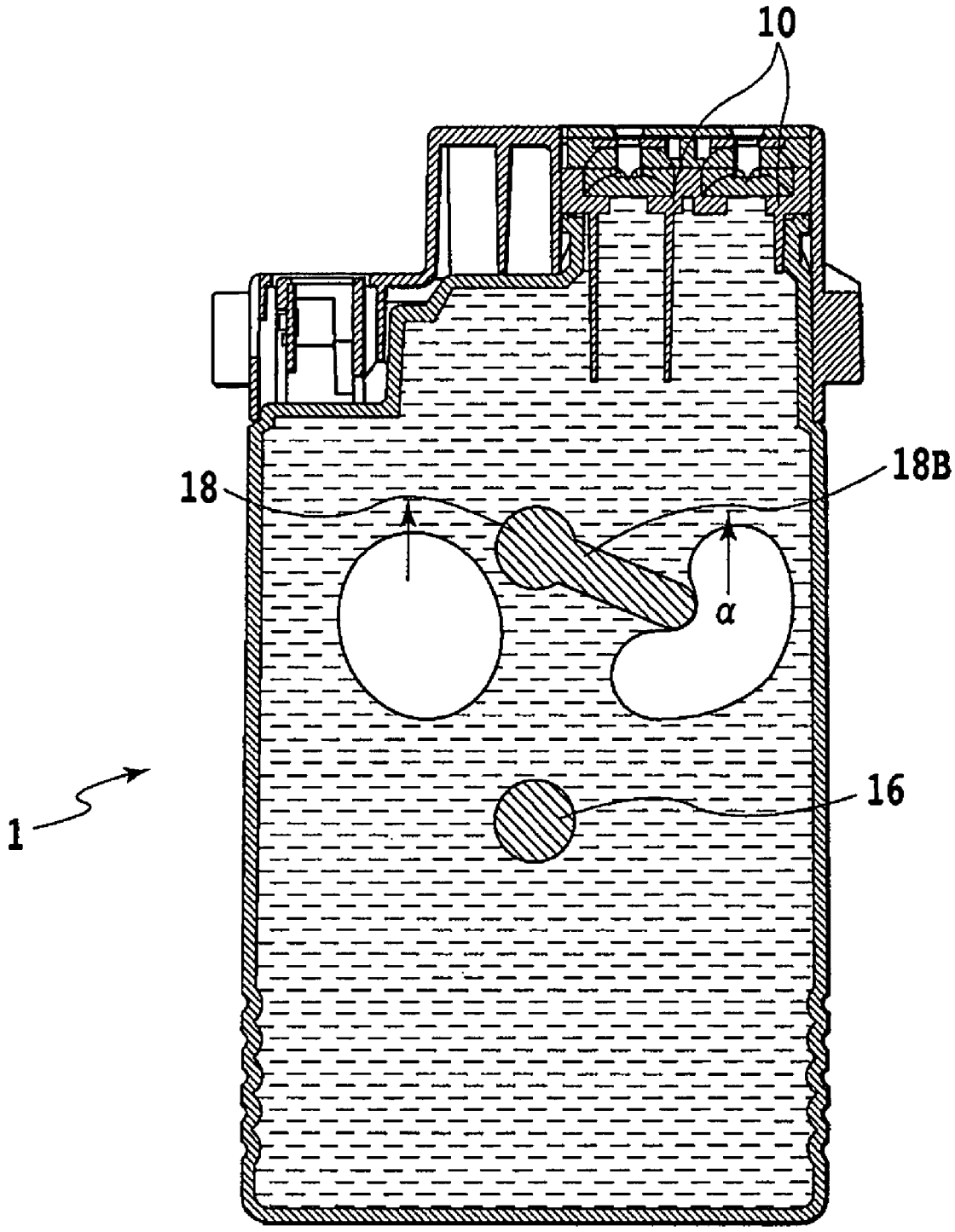
FIG. 5 is a cross-sectional view of the ink tank for illustrating a state where the air goes ascending while passing through a portion α.
Figure 6:
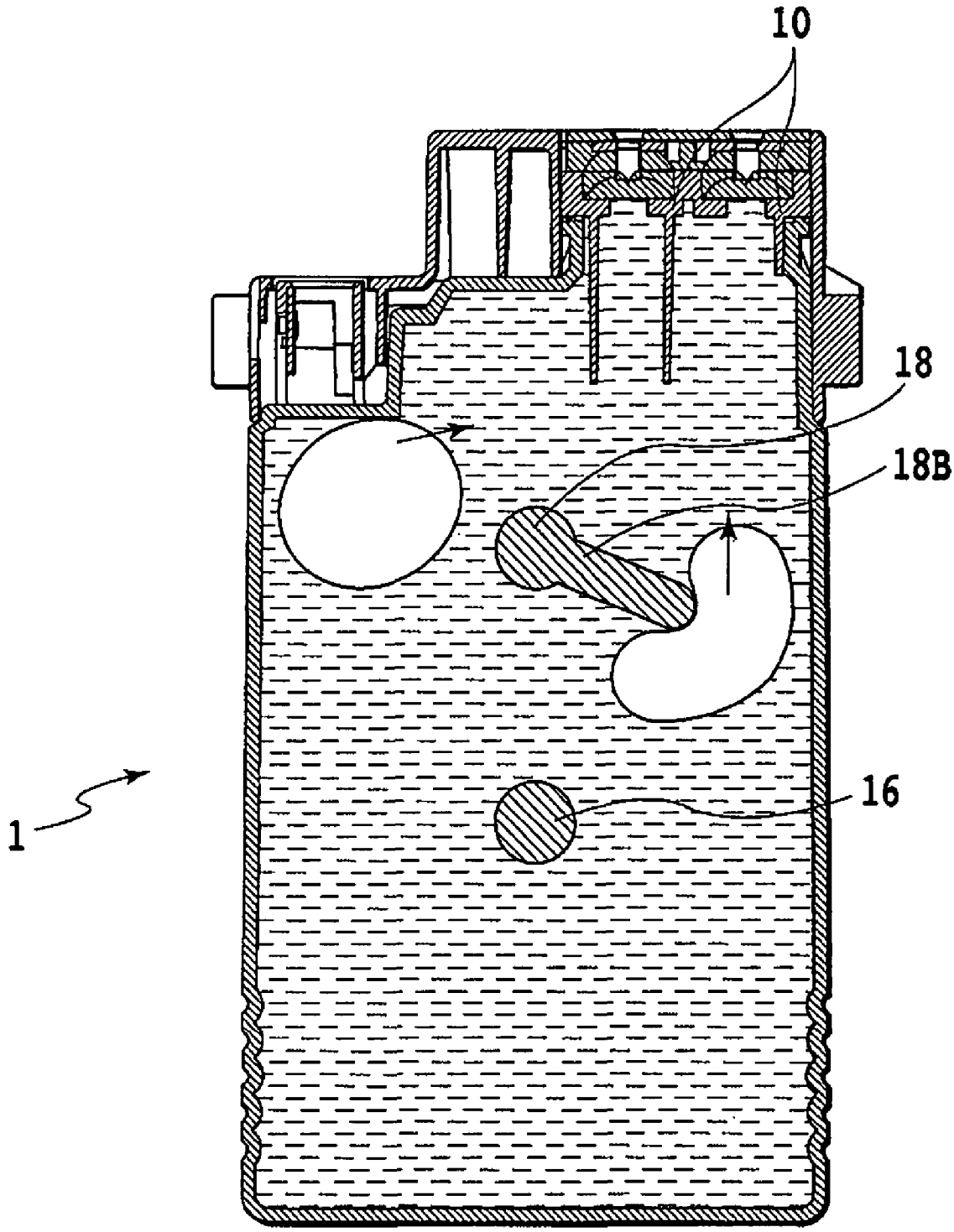
FIG. 6 is a cross-sectional view of the ink tank for illustrating a state where the air further goes ascending from the state in FIG. 5.

FIG. 2 shows the ink tank in the posture at the time when mounted on the printing apparatus, and the posture allowing the ink supply portion 10 to face the ink supply needle and the atmosphere communicating needle which are included in the printing apparatus side. Additionally, as will be described later, this is a state where the ink tank is wrapped in a package, and a state where the ink tank 1 is suspended with a hole provided to the package. The ink supply portion 10 is provided on the bottom face (first end portion) side which is the lowest portion in a gravity direction in this posture. FIG. 3 shows a state of the ink tank at the moment when the turnover operation is just performed from a state shown in FIG. 2. FIG. 4 illustrates the ink tank in which the air goes ascending after the turnover operation causes the air to be situated for a moment in the lowest portion of the ink tank, as shown in FIG. 3. The air reaches the air separating portion 16, and here the air is separated into separated air pieces. FIGS. 5 and 6 respectively show processes in which each of the separated air portions goes ascending. One of these separated air pieces continues ascending uninterruptedly by passing through a region which does not include the inclined portion 18B, and will reach the uppermost portion of the ink contained in the ink tank 1 earlier than the other separated air piece. After having bumped once against the inclined portion 18B, the other separated air piece ascends therefrom by passing through the narrow portion $\alpha$, and then reaches the uppermost portion.

Figure 7:
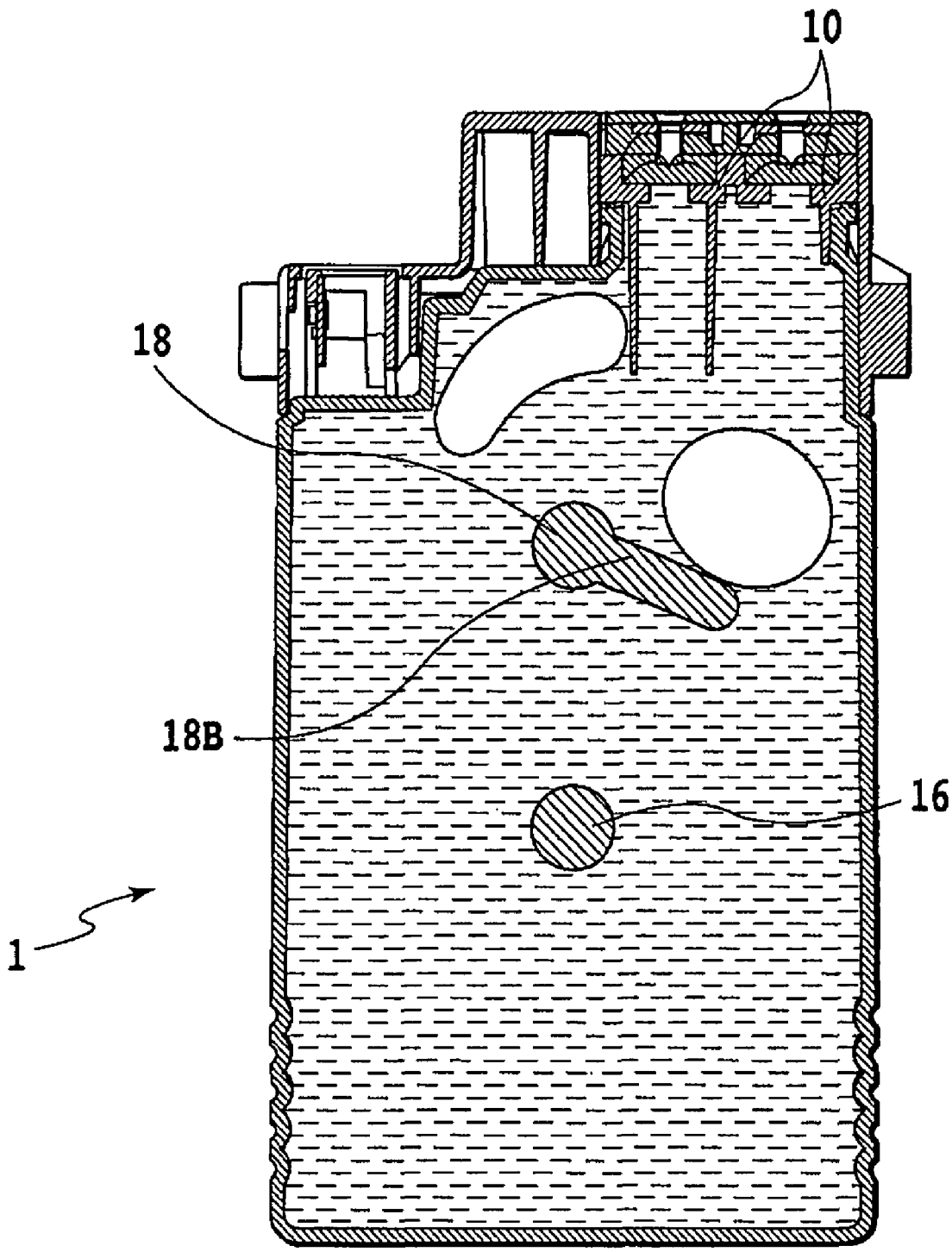
FIG. 7 is a cross-sectional view of the ink tank for illustrating a state where the air further goes ascending from the state in FIG. 6.

FIG. 7 shows a state where the one separated air piece ascending earlier almost reaches the vicinity of the uppermost portion, while the other separated air piece passing through the narrow portion $\alpha$ is supposed to reach the vicinity with a time lag after the one separated air piece reaches. When the turnover operation is performed, the pigment component having settled out in advance near the ink supply portion does not immediately move downward along with the ink, but slowly goes descending toward the face opposite to the face having the ink supply portion. Accordingly, these separated air pieces contribute to dispersion of the pigment component by going ascending toward the uppermost portion of the ink contained in the ink tank 1 with a time lag.

Figure 8:
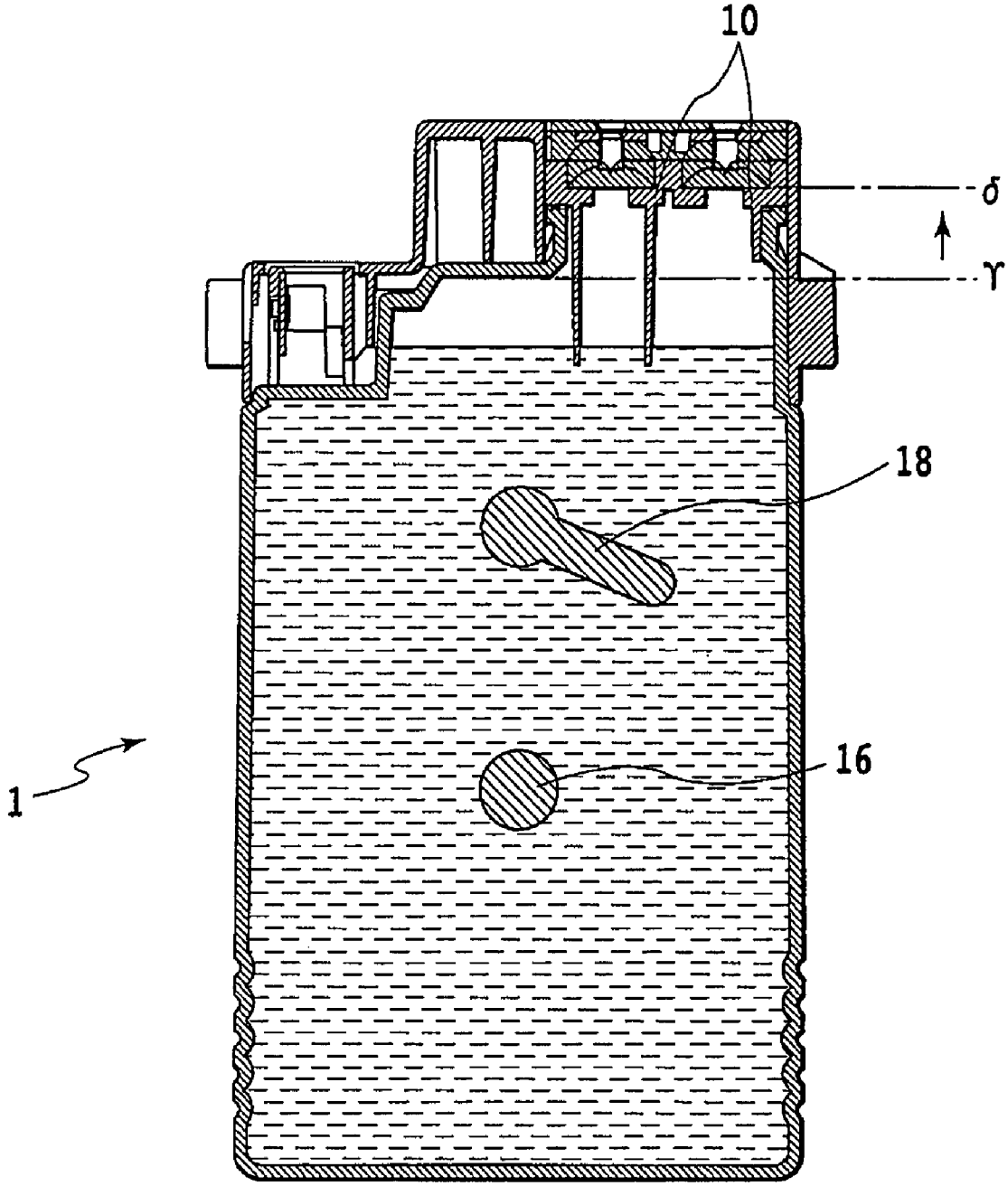
FIG. 8 is a cross-sectional view of the ink tank for illustrating a state where the air finishes ascending.
Figure 9:
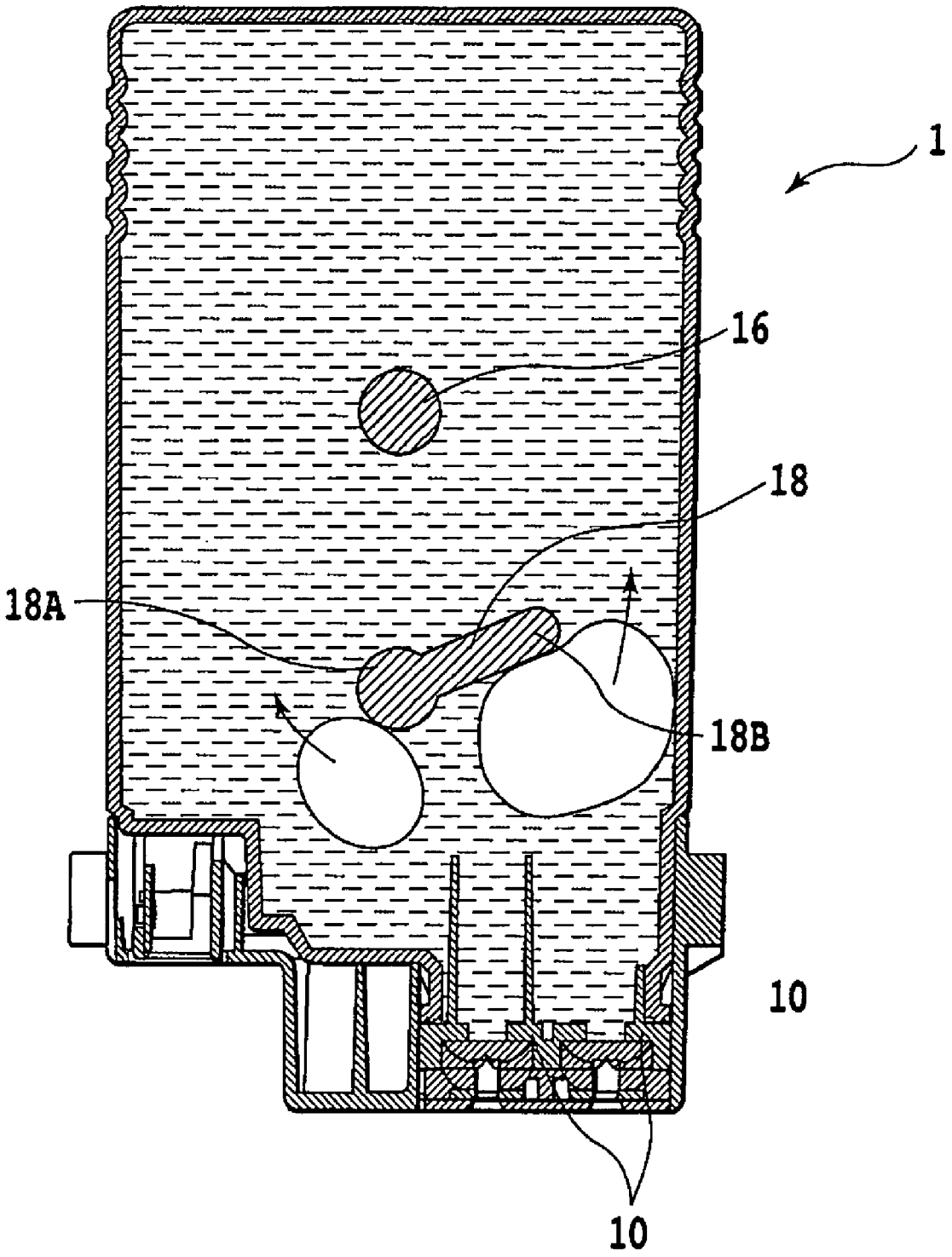
FIG. 9 is a cross-sectional view of the ink tank for illustrating a state where the air goes ascending after a subsequent turnover operation is performed from the state in FIG. 8.

FIG. 8 shows a state where all the air has finished ascending after the turn over operation. As shown in FIG. 8, the air gathers on the face having the ink supply portion, whose current location is the highest in the tank. The ink tank has a configuration in which: the ink supply portion 10 is located off to the one side wall (located off to the right side in FIG. 8); and the ink supply portion is located at the position δ protruding in a direction shown by an arrow in FIG. 8 from the position γ corresponding to one bottom face of the ink tank. Since the ink tank has this configuration, the amount of air existing between the one side end and the central axis V in the ink tank is larger than the amount of air existing between the other side end and the central axis V in the ink tank. Specifically, the air is located in an upper right part in FIG. 8. Accordingly, when a subsequent turnover operation is performed from this state, the air comes to be situated for a moment in the lowest section, and then starts ascending as shown in FIG. 9. As shown in FIG. 9, the air bumps into the air separating portion 18 at first, and at this point, the amount of one separated air piece, which is to pass through the narrow portion α, becomes larger than the amount of the other separated air piece. Additionally, the inclined portion 18B forms a face which is inclined upward to the narrow portion α when viewed from one side of the ink tank where the air exists, and which is inclined downward from the narrow portion α when viewed from the other side of the ink tank where the ink exists. Accordingly, a major piece of the air is to ascend by passing through the narrow portion, while the other piece of the air is to ascend by passing through the wider gap portion opposite to the narrow portion. Both of these pieces of the air are to ascend by passing by the respective sides of the air separating portion, against the ink which is to descend inside the ink tank.

Figure 10:
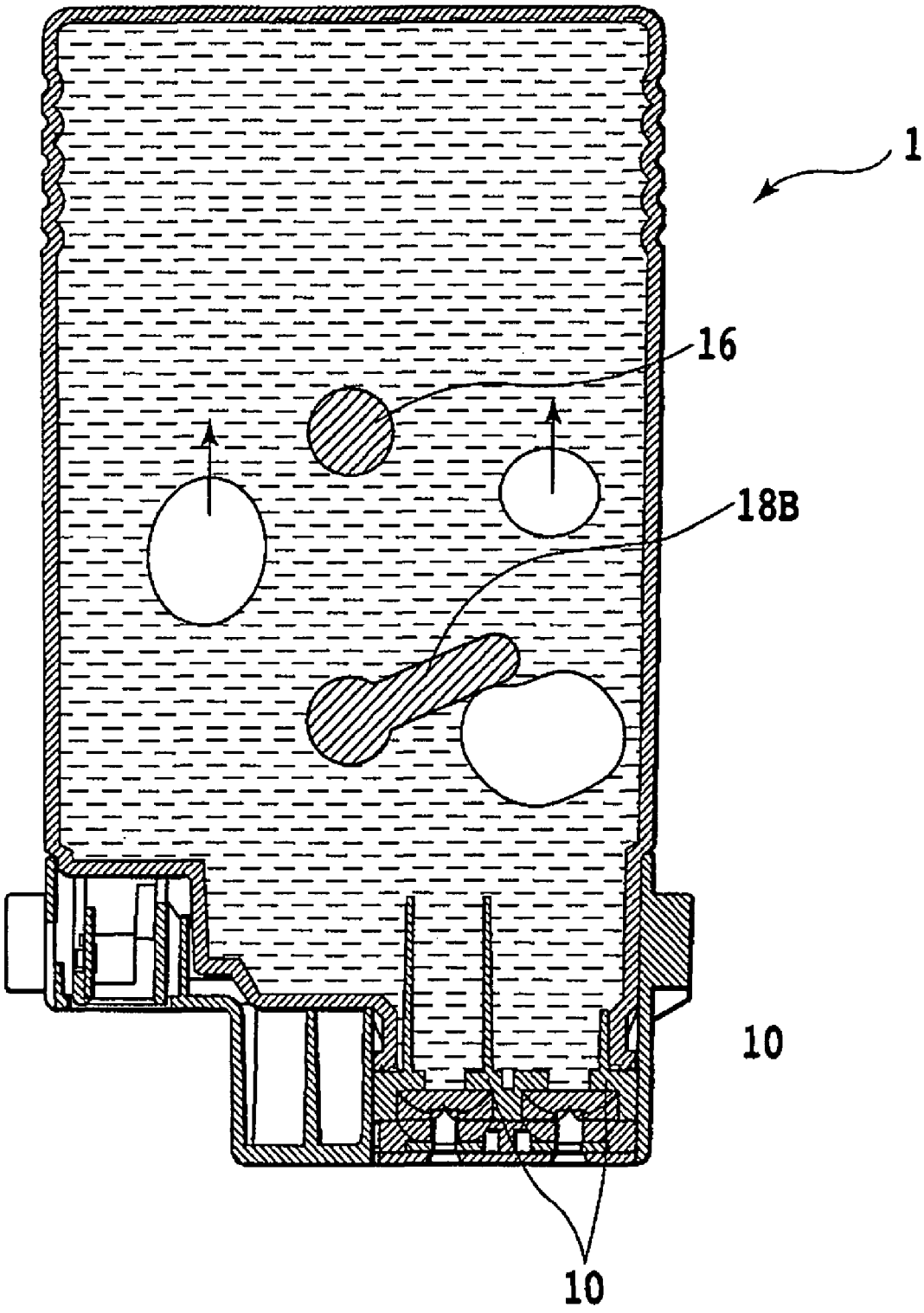
FIG. 10 is a cross-sectional view of the ink tank for illustrating a state where the air further goes ascending from the state in FIG. 9.
Figure 11:
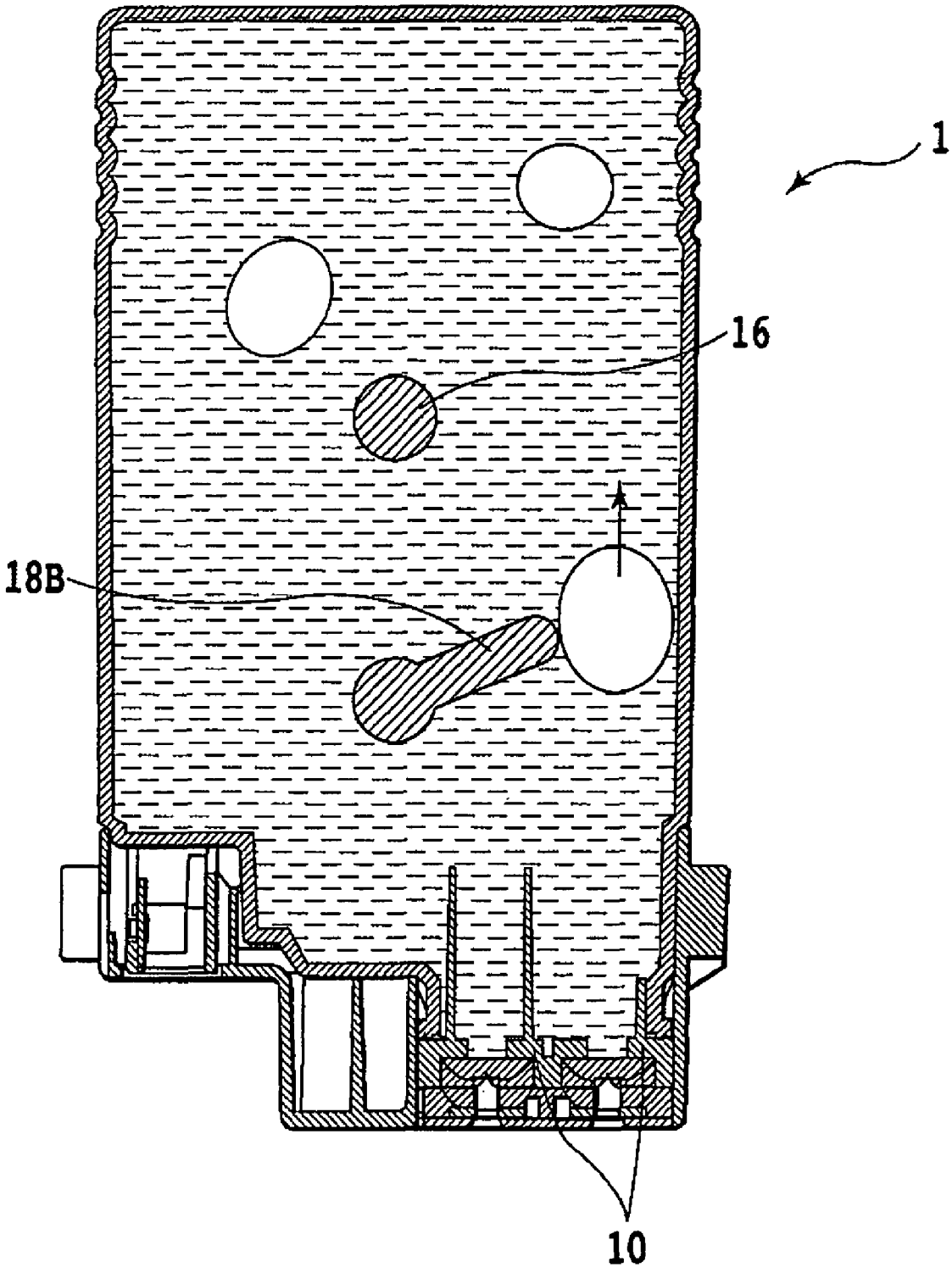
FIG. 11 is a cross-sectional view of the ink tank for illustrating a state where the separated air pieces go ascending.

The one separated air piece in the larger amount, which passes through the narrow portion, does not pass through it as a whole, but is further separated as shown in FIG. 10 when passing through it. Then, as shown in FIG. 11, a separated air piece which has passed through the narrow portion first, the separated air piece which has passed through the wider gap portion, and the other separated air piece which has passed through the narrow portion later sequentially go ascending. In other words, these separated air pieces go ascending inside the ink tank with time lags, and therefore, can contribute to dispersion of the pigment component in a plurality of locations as is the case with the foregoing turnover operation.

Incidentally, FIGS. 5 and 7 and FIGS. 9 to 11 illustrate that the air is separated into some large pieces. However, according to an experiment, it was confirmed that a large number of relatively small separated air pieces were generated in association with each of relatively large separated air pieces, and that all of these separated air pieces were making random and complicated movements in the course of ascending along with the turnover operation. According to the configuration of the present embodiment, stirring actions are promoted by movements of such separated air pieces (bubbles).

What has been mentioned above means that it is only necessary to perform a small number of the turnover operations in order to obtain a state where the pigment component is favorably dispersed, i.e., a state where there is no sloped distribution of concentration of the pigment component in a vertical direction of the tank. In other words, it means that a user is only required to perform a small number of the turnover operations, and that a user is not required to vigorously shake the ink tank, or to perform a large number of the turnover operations. Additionally, this allows a user to unconsciously perform the stirring operation by performing a series of procedures for mounting the ink tank. This point will be described below.

Figure 12:
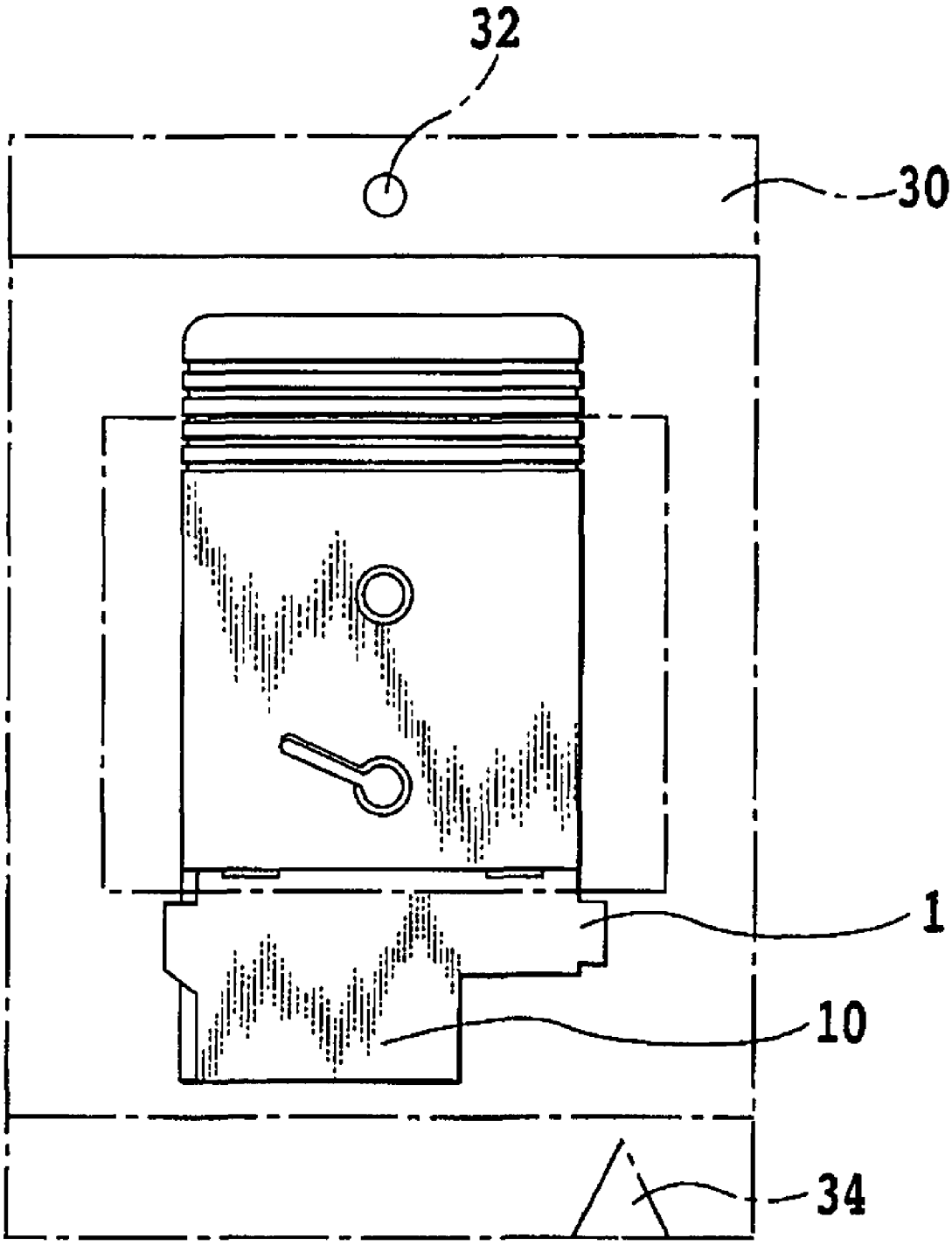
FIG. 12 is a front view showing a package in which the ink tank of the first embodiment is wrapped.

FIG. 12 shows a package in which the ink tank according to the present embodiment is wrapped. Here, a member denoted by reference numeral 30 is a bag-like pack member (wrapping member), and is hermetically housing an unused ink tank 1. A hole 32 is provided near one edge portion of the pack member 30, whereby the pack member 30, i.e., the package can be suspended with a hook or the like inserted into this hole. The ink tank 1 is housed so that the ink supply portion 10 would be located in an edge portion opposite to the edge portion having the hole 32. Thus, the pack member 30 is suspended with a hook or the like inserted into the hole 32, and thereby the ink tank 1 is displayed or stored in a posture in which the supply portion faces downward in the vertical direction, as in the posture at the time when the ink tank is mounted and used. In this state, the pigment component settles near the ink supply portion 10.

In order to take out the ink tank at the start of using it, a notch 34 is formed for facilitating an operation of breaking the pack member 30 in an edge portion facing the ink supply portion 10 in outer edge portions of the pack member. The user firstly performs an operation of making the notch 34 face upward so as to take out the ink tank. Along with this operation, the ink supply portion becomes upward in the gravity direction. Then, in order to mount the ink tank in the printing apparatus, after having taken out the ink tank by breaking the pack member, the user makes the ink supply portion face downward in the gravity direction. These operations naturally involve the turnover operations of the ink tank 1. With mounting the ink tank in the printing apparatus after the turnover operations, the ink supply portion comes to face downward in the gravity direction.

As has been described above, in the present embodiment, a configuration of the pack member housing the ink tank, that includes positions of the hole 32 used for suspension at the times of storage and the like, and of the notch 34 used for taking out the ink tank, is appropriately determined, and also, a posture of the ink tank 1 at a time when it is housed in the pack member is appropriately determined. Thereby, the turnover operations are inevitably performed in a series of procedures for mounting, whereby stirring of the ink is inevitably promoted. Thereby, it becomes possible to reduce a load on the user.

The hole used for suspension is not necessarily required. It is only necessary that the supply portion should face upward when the notch is opened, and face downward after the mounting, in the gravity direction.

Second Embodiment

The ink tank is not limited to the above described embodiment, and may have various configurations.

Figure 13:
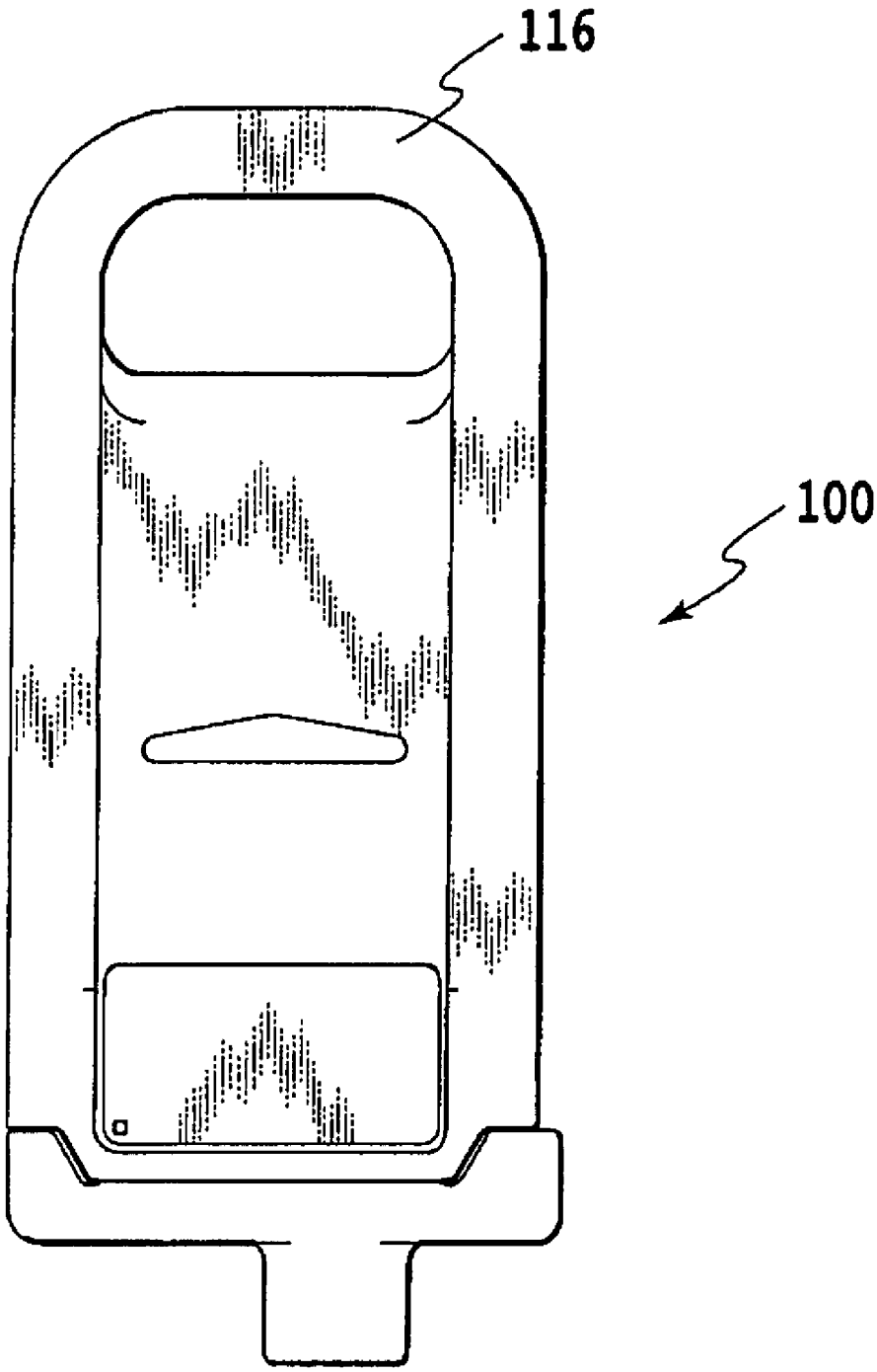
FIG. 13 is a front view of an external shape of an ink tank according to a second embodiment of the present invention.
Figure 14:
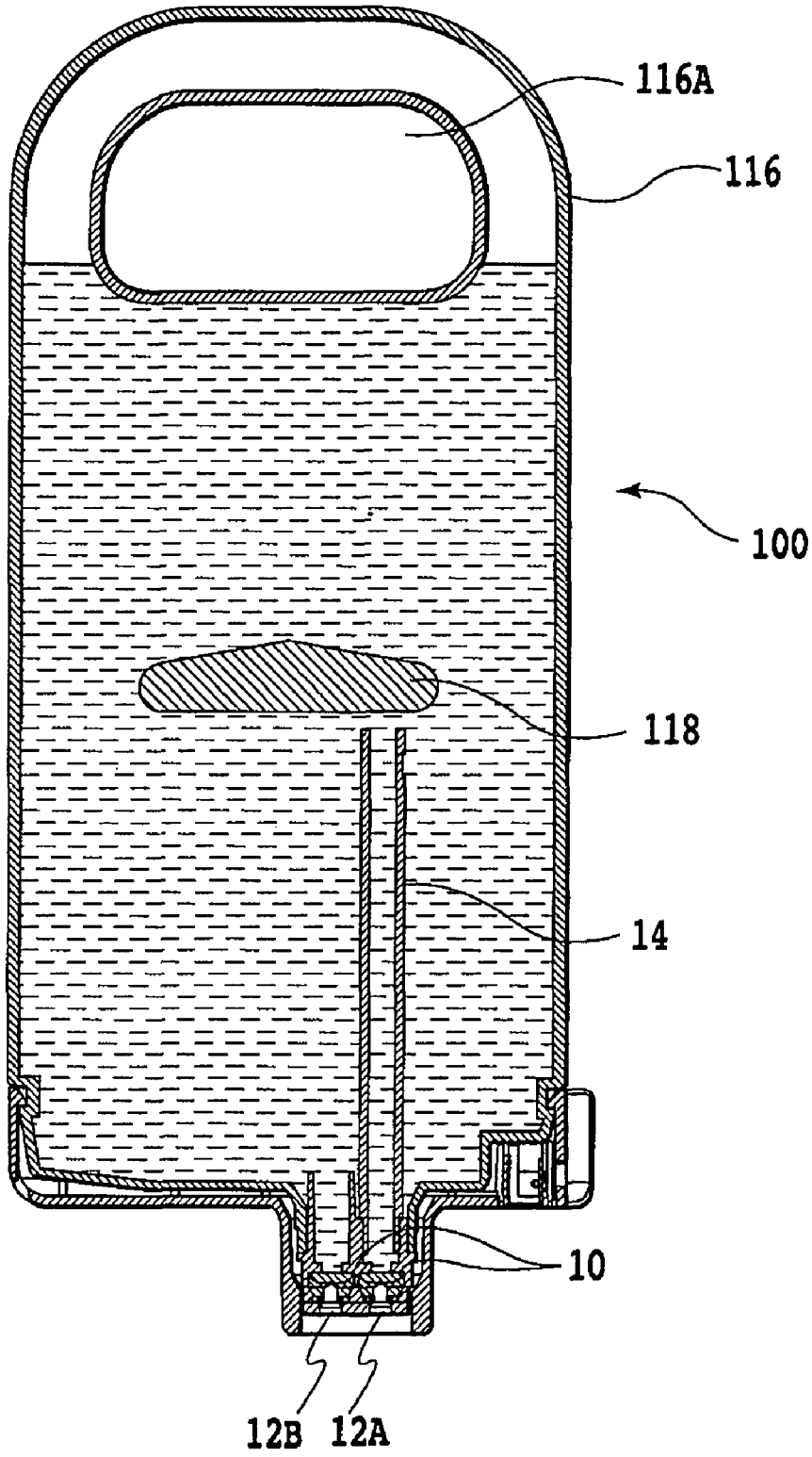
FIG. 14 is a cross-sectional view of an interior of the ink tank according to the second embodiment.

FIGS. 13 and 14 are a side view and a cross-sectional view, respectively, which show an ink tank according to a second embodiment of the present invention. The same reference numerals are given to locations corresponding to the members configured and arranged in the same manners as those in the aforementioned first embodiment.

In the case of an ink tank 100 in the present embodiment as well, a tank casing directly functions as an ink chamber, and contains a predetermined amount of air. Although the ink tank 100 of the present embodiment also has a shape of a substantially rectangular solid, an end portion opposite to an end potion having an ink supply portion 10 is formed into a torus structure, and can be grasped by a user when the user handles the ink tank. The torus structure is configured to be hollow, and allows fluid to exist inside the torus. This torus structure functions also as one of air separating portions of the second embodiment.

The other one of the air separating portions which is an air separating portion 118 can be configured in the same manner as that of the air separating portion 16 of the first embodiment. In this example, in a posture at the time of being mounted as shown in FIGS. 13 and 14, the air separating portion 118 has a shape of a substantially flat isosceles triangle having an apex angle at a high position on a longitudinal central axis. The "posture at the time of being mounted" means that the ink supply portion 10 of the ink tank faces an ink supply needle and an atmosphere communicating needle which are provided to a main body of a printing apparatus.

Hereinbelow, a stirring operation of the ink tank of the present embodiment, and actions involved in this operation will be described.

The ink tank 100 is manufactured so as not to be completely filled with ink, but to contain a predetermined amount of air therein. In this state, while an air-liquid interface (a liquid level of the ink) is formed in a position higher than a bottom of a cavity portion 116A of the torus structure of the air separating portion 116, and pigment component settles around the ink supply portion.

Figure 15:
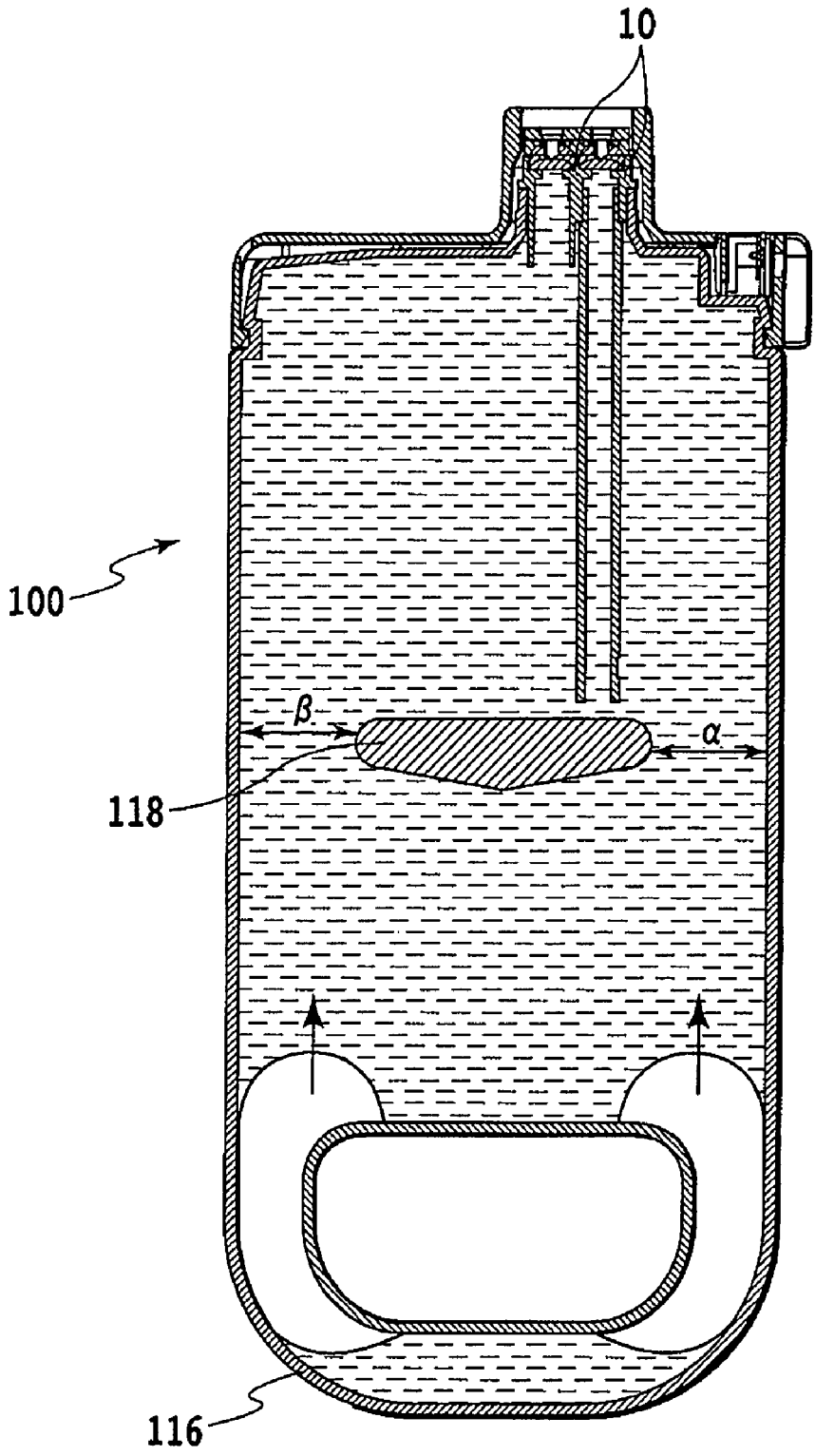
FIG. 15 is a cross-sectional view of the ink tank immediately after a turnover operation is performed from a state in FIG. 14.
Figure 16:
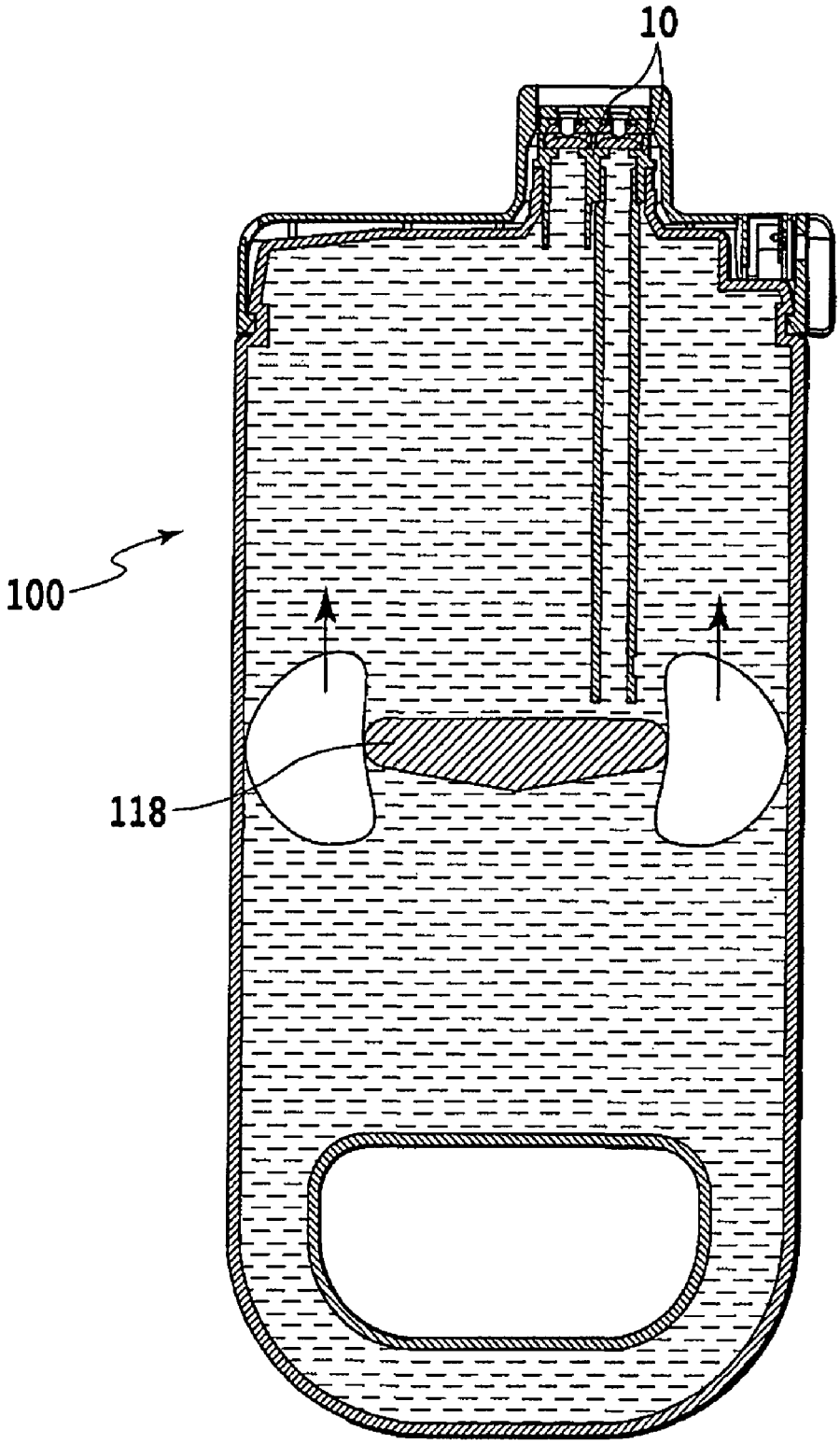
FIG. 16 is a cross-sectional view of the ink tank for illustrating a state where the separated air pieces go ascending.
Figure 17:
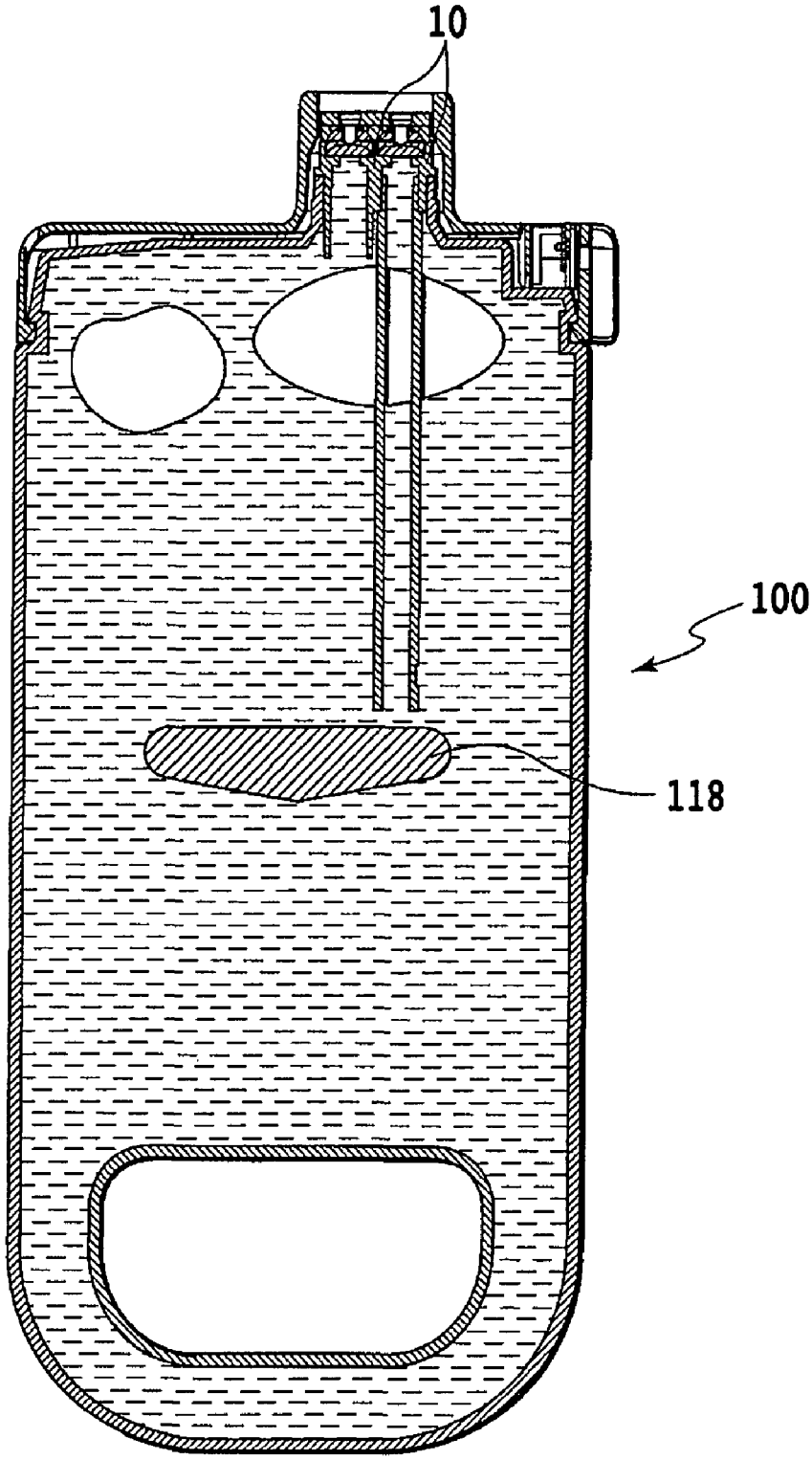
FIG. 17 is a cross-sectional view of the ink tank for illustrating a state where the air goes ascending from the state in FIG. 16.

FIG. 15 shows a state where the air is separated, and goes ascending from the air separating portion 116 by performing the turnover operation from a state in FIG. 14. The air separating portion 118 is formed substantially at the center in a left-to-right direction in FIG. 15 inside the tank. Since the structure of the torus portion is made bilaterally symmetric, the air is separated into one piece in a left part of the tours structure, and the other piece in a right part thereof. As shown in FIGS. 15 and 16, these separated air pieces almost concurrently pass respectively through two gaps $\alpha$ and $\beta$, and go ascending uninterruptedly. Here, the gaps $\alpha$ and $\beta$ are formed between the air separating portion 118 and the respective side walls. However, arrival times at which the respective separated air pieces reach the uppermost portion of the ink contained in the ink tank in the gravity direction, and the amounts of the respective separated air pieces become different as shown in FIG. 17, because the ink tank has a structure in which the ink supply portion 10 is located off to one side wall, and which has a supply pipe therein. Accordingly, also in the present embodiment, these separated air pieces contribute to dispersion of the pigment component by reaching the uppermost portion with a time lag.

Thereafter, the air gathers on the end portion having the ink supply portion 10, whose current location is the highest in the ink tank. Since the ink supply portion 10 is located off to the one side wall, the amount of air existing between one side end and a central axis of the tank (in an upper right part in FIG. 17) is larger than the amount of air existing between the other end and the central axis of the tank (in an upper left part therein). Accordingly, in a case where the turnover operation is further performed, there occurs a difference between the amounts of the separated air pieces which are separated by the air separating portion 118. Specifically, the amount of air passing through a gap a between the air separating portion 118 and a side wall of the one side end is larger than that through the opposite gap. This separated air piece passing through the gap $\alpha$ does not pass through the gap as a whole, but is further separated into pieces. As a result, these separated air pieces thus further separated go ascending with a time lag, and therefore, can contribute even more to dispersion of the pigment component.

(Amount of Air in Ink Tank)

Figure 18:
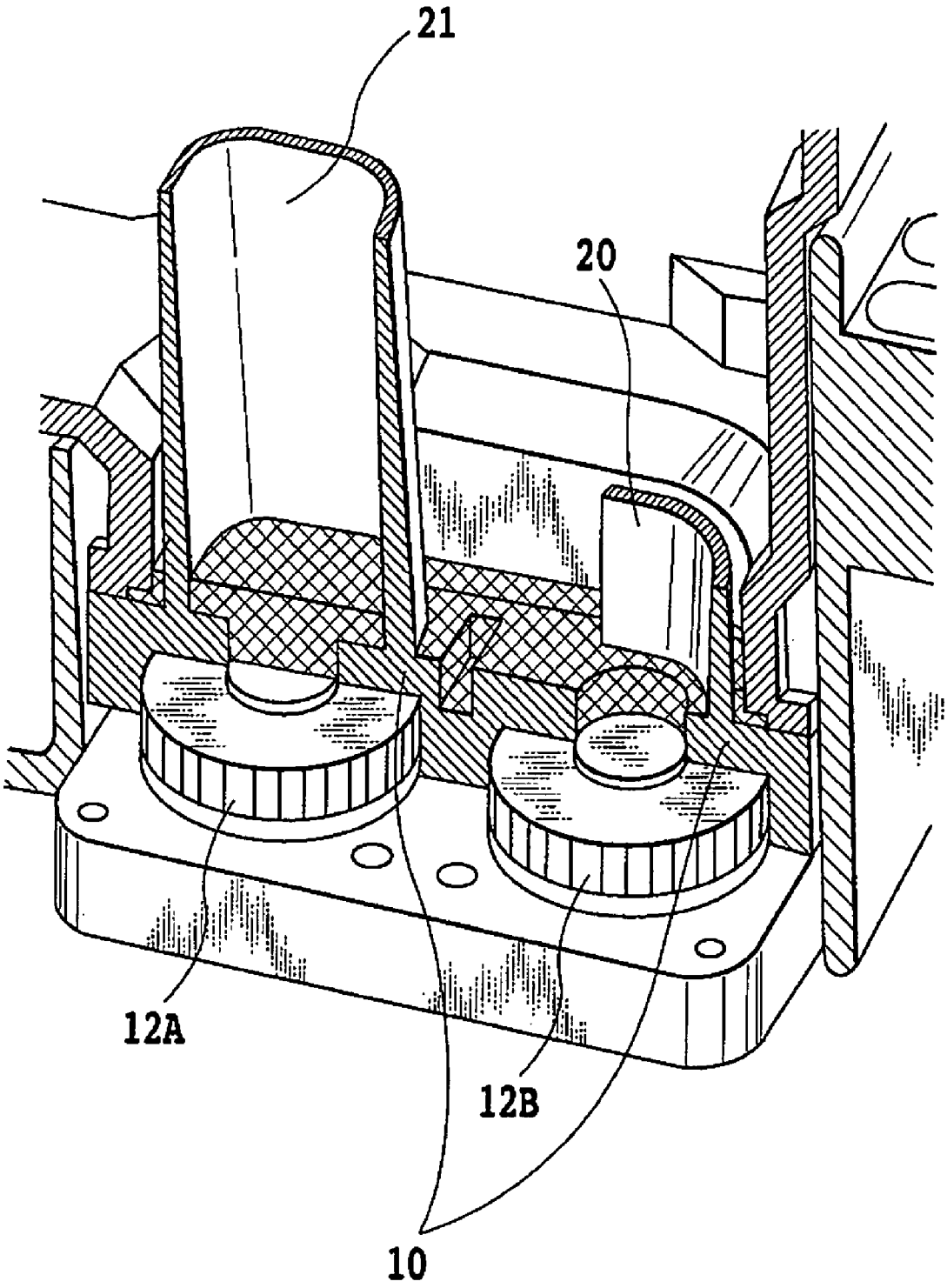
FIG. 18 is a perspective cutaway view showing a vicinity of an ink supply portion of the ink tank according to the first embodiment.
Figure 19:
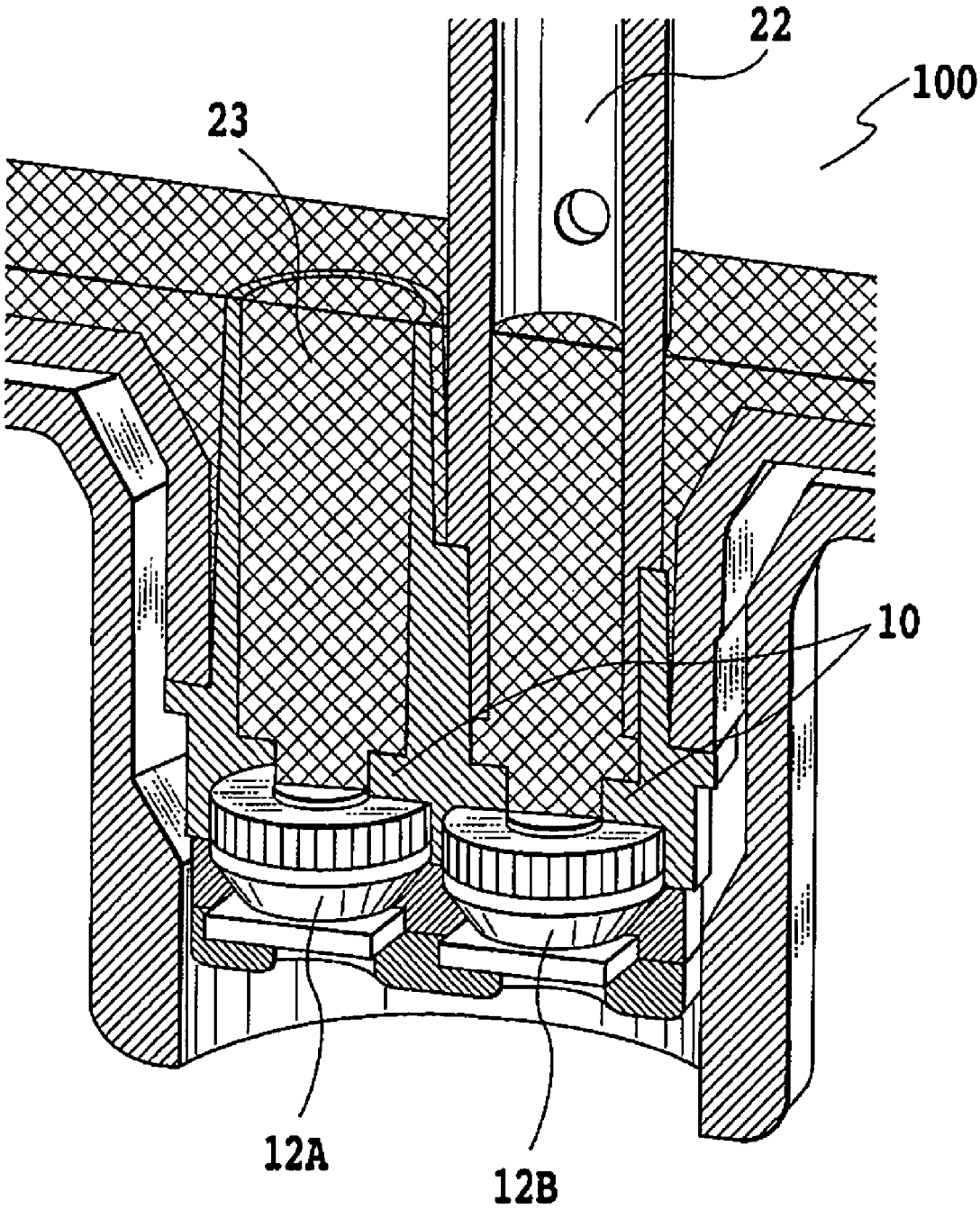
FIG. 19 is a perspective cutaway view showing a vicinity of an ink supply portion of the ink tank according to the second embodiment.

As has been described in the first and second embodiments above, the present invention adopts a configuration which allows ink to be effectively stirred by efficiently separating air existing inside an unused ink tank into pieces, and by guiding independently each of the separated air pieces. Accordingly, the initial amount of air existing inside the ink tank, or the initial amount of filled ink, at the time of manufacture or during an un-mounted state is an important factor in designing and manufacturing the ink tank. Each of FIGS. 18 and 19 shows a state where at least any one of an ink supply pipe which is a constituent member of an ink supply portion, an atmosphere communicating pipe which is also a constituent member of the ink supply portion, and the like is in contact with the air. Any space indicated with a meshed pattern is a space in which the air exists. In FIG. 18, reference numerals 20 and 21 denote the ink supply pipe and the atmosphere communicating pipe, respectively. In FIG. 19, reference numerals 22 and 23 denote the ink supply pipe and the atmosphere communicating pipe, respectively.

In the present invention, it is premised that the air exists beforehand inside the ink tank. The air must exist in the amount which allows effective stirring actions to be achieved. If the amount of the air is not enough, sufficient air separation and a favorable state of movements cannot be obtained. As a result, pigment component having a lager specific gravity does not disperse in the ink, but only moves from a higher position to a lower position inside the ink tank. In each of the ink tanks presented in examples of the first and second embodiments, the minimum initial amount of the air is the amount which brings about a state where at least any one of the aforementioned constituent members of the ink supply portion is in contact with the air.

In addition, the maximum initial amount of the air has to be the amount which makes it possible to achieve a desired stirring effect.

The specification of the initial amount of air, or the initial amount of filled ink is exactly the specification of the initial height of an air-liquid interface formed inside the ink tank when the ink tank is in the same posture as that, for example, at the time of being stored or mounted. The posture at this time corresponds to a posture in which the ink supply portion faces needles of a printing apparatus, that is, a case where the supply portion faces downward in the gravity direction. The initial amount of air or the initial amount of filled ink is the amount which should enable the air separating portions to perform effective air separation and movements. The initial height of the air-liquid interface can be determined in relation to the positions of the air separating portions.

Figure 20:
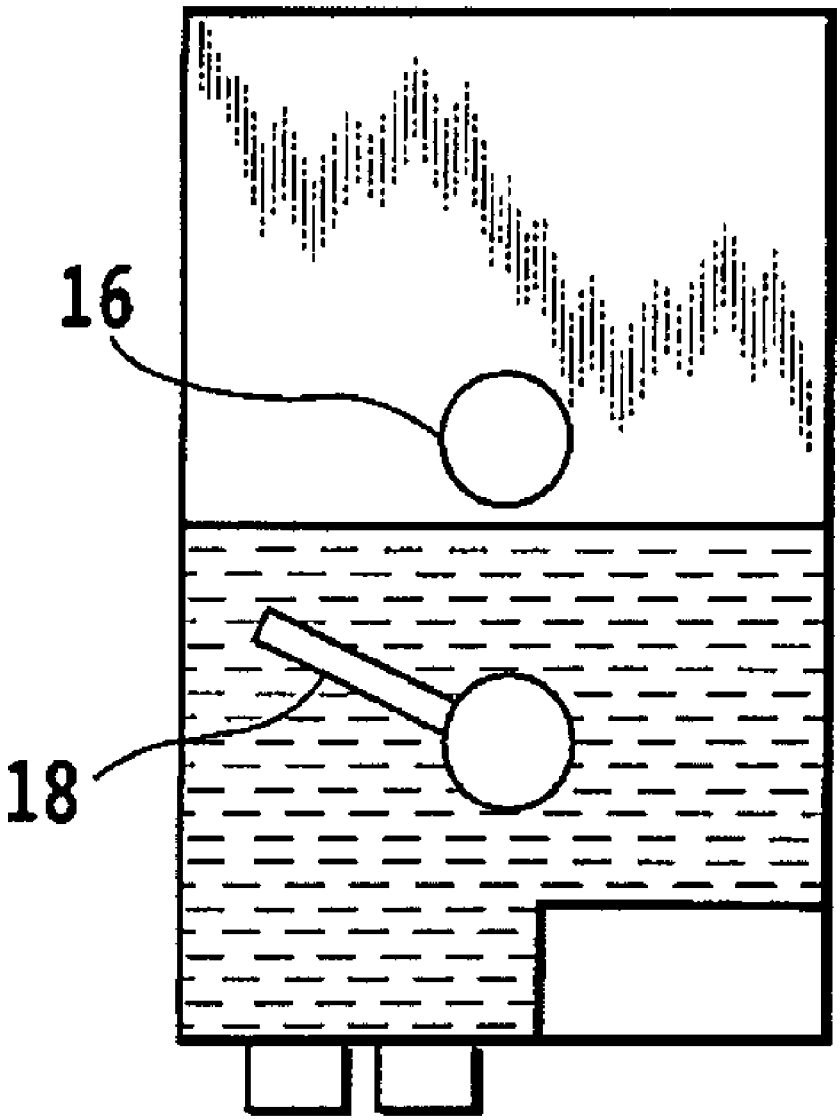
FIG. 20 is a schematic view for illustrating a specification of an amount of air existing in an ink tank.

As shown in FIG. 20, in a case where the air is favorably separated into pieces in the course of ascending of the air as a result of a turnover operation, the air-liquid interface is located at the same level as or the higher level than the air separating portions before the turnover operation. In a case where the air-liquid interface is located below the level of the air separating portions, that is, in a case where the air is surrounding the air separating portions, even the turnover operation may not cause the air to be separated. As a result, a plurality of separated air pieces may not reach the uppermost portion of the ink contained in the ink tank in the gravity direction with time lags, that is, ink may not be effectively stirred. It is important that the initial amount of air, that is, the initial amount of filled ink be determined so that the air-liquid interface would be located at the same level as or the higher level than the air separating portions before the turnover operation is performed.

In line with the configurations of the above described embodiments, the specification of the height of the air-liquid interface will be described.

In the first embodiment, the two air separating portions 16 and 18 exist in a vertical direction in the posture at the time of being stored or mounted. These are located at a relatively high position and at a relatively low position, respectively, with respect to the ink supply portion. With this configuration, if the air-liquid interface exists at the level higher than the air separating portion 16, performing the turnover operation allows the two air separating portions 16 and 18 to achieve the efficient air separation as described above. However, the initial amount of air, that is, the initial amount of filled ink can be determined so that the air-liquid interface would be located at a position between the air separating portions 16 and 18, on condition that a stirring effect of a certain level can be obtained only with one of the air separating portions when the turnover operation is performed.

The same is true with the configuration of the second embodiment. In other words, the initial amount of air, that is, the initial amount of filled ink can be determined so that the air-liquid interface would be located at a position between the air separating portion 116 having the torus structure, and the air separating portion 118.

Incidentally, both of the first and second embodiments have the configurations each including the two air separating portions. In generalizing these embodiments to a case where there are a plurality of air separating portions in the ink tank, the initial amount of filled ink may be determined so that the air-liquid interface would be located at a position at the same level as or the higher level than at least one of the air separating portions.

While the present invention has been described with reference to exemplary embodiments, it is to be understood that that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-099816, filed Mar. 31, 2006, which is hereby incorporated by reference herein in its entirety.

What is claimed is:

1. An ink container for containing ink and air comprising:

an ink supply portion;

a bar extending from a side wall of the ink container so as to cross an inside of the ink container, the bar being positioned to separate air ascending toward the ink supply portion into a plurality of pieces of air; and an extending wall located between the ink supply portion and the bar and positioned to give resistance to the ascent of at least one of the pieces of air separated by the bar and ascending toward the ink supply portion.

2. The ink container as claimed in claim 1, wherein the ink container is distributed and sold in a state where the ink container is wrapped in a package, and the package has a suspension hole for displaying in a state where a bottom face provided with the ink supply portion and also provided with an atmosphere introducing portion faces downward and a portion for opening the package at an opposite side to a side at which the suspension hole is provided.

3. The ink container as claimed in claim 1, wherein:

the ink supply portion is provided so as to protrude from a bottom face of the ink container; and the extending wall is inclined with respect to the bottom face and extends so as to cover over the ink supply portion.

4. The ink container as claimed in claim 1, wherein the bar is configured as a columnar structure.

5. The ink container as claimed in claim 1, further comprising an air-ink interface between the air and the ink, wherein the air-ink interface is located at the same level as or a lower level than the bar when the ink container in a posture where a bottom face of the ink container faces vertically upward.

6. The ink container as claimed in claim 1, further comprising a casing having a plurality of faces including a side face, the casing for containing ink which includes pigment;

wherein the casing has a shape of a substantially rectangular solid formed from the plurality of faces, wherein the side face has a paired side face, and wherein the pair of side faces form maximum areas of the casing.

7. The ink container as claimed in claim 6, wherein the extending wall is connected to both of the pair of side faces forming the maximum areas, and is not connected to other faces, so as to form a narrow gap portion between the extending wall and a respective one of the other faces.

8. The ink container as claimed in claim 7, wherein the at least one piece of air is guided by the extending wall to ascend toward the ink supply portion through the narrow gap portion.

9. The ink container as claimed in claim 8, wherein the at least one piece of air arrives at the ink supply portion later than another of the plurality of pieces of air to which the extending bar does not give resistance.

10. The ink container as claimed in claim 7, wherein the bar has a substantially circular cross section.

11. The ink container as claimed in claim 6, further comprising an atmosphere introducing portion, wherein the ink supply portion and the atmosphere introducing portion are both provided at a bottom face of the casing.

12. The ink container as claimed in claim 11, wherein the ink is directly contained in the ink container.

* * * * *